US012680210B2

(12) United States Patent
Kang et al.

(10) Patent No.: US 12,680,210 B2
(45) Date of Patent: Jul. 14, 2026

(54) CLOTHES HANDLING DEVICE

(71) Applicants: LG ELECTRONICS INC., Seoul (KR); KOREA ADVANCED INSTITUTE OF SCIENCE AND TECHNOLOGY, Daejeon (KR)

(72) Inventors: Dongsoo Kang, Seoul (KR); Hyunseok Seo, Seoul (KR); Jungwoo Choi, Seoul (KR); Yusun Shul, Seoul (KR)

(73) Assignees: LG Electronics Inc., Seoul (KR); Korea Advanced Institute of Science and Technology, Seoul (KR)

( * ) Notice: Subject to any disclaimer, the term of this patent is extended or adjusted under 35 U.S.C. 154(b) by 53 days.

(21) Appl. No.: 18/835,813

(22) PCT Filed: Feb. 6, 2023

(86) PCT No.: PCT/KR2023/001673
§ 371 (c)(1),
(2) Date: Aug. 5, 2024

(87) PCT Pub. No.: WO2023/149771
PCT Pub. Date: Aug. 10, 2023

(65) Prior Publication Data

US 2025/0137183 A1 May 1, 2025

(30) Foreign Application Priority Data

Feb. 4, 2022 (KR) ..... 10-2022-0014796

(51) Int. Cl.
*D06F 33/47* (2020.01)
*D06F 23/02* (2006.01)
(Continued)

(52) U.S. Cl.
CPC ..... *D06F 33/47* (2020.02); *D06F 23/02* (2013.01); *D06F 33/36* (2020.02); *D06F 33/38* (2020.02); *D06F 33/40* (2020.02); *D06F 34/04* (2020.02); *D06F 34/18* (2020.02); *D06F 34/20* (2020.02); *D06F 34/32* (2020.02); *D06F 39/12* (2013.01); *D06F 2103/04* (2020.02); *D06F 2103/24* (2020.02); *D06F 2103/26* (2020.02); *D06F 2103/46* (2020.02); *D06F 2105/48* (2020.02); *D06F 2105/58* (2020.02)

(58) Field of Classification Search
CPC ..... D06F 33/47
See application file for complete search history.

(56) References Cited

U.S. PATENT DOCUMENTS

2021/0277564 A1* 9/2021 Mashal ..... D06F 33/34

FOREIGN PATENT DOCUMENTS

JP 2013-052062 A 3/2013
JP 2020-049036 A 4/2020
(Continued)

OTHER PUBLICATIONS

International Search Report and Written Opinion in International Appln. No. PCT/KR2023/001673, mailed on Jun. 8, 2023, 15 pages (with English translation).

*Primary Examiner* — Jason Y Ko
(74) *Attorney, Agent, or Firm* — Fish & Richardson P.C.

(57) ABSTRACT

The present disclosure relates to a clothes handing device that can receive at least one of a sound signal, driving information, or cycle information, and determine and classify an abnormal state.

16 Claims, 18 Drawing Sheets

(51) Int. Cl.

| | |
|---|---|
| ***D06F 33/36*** | (2020.01) |
| ***D06F 33/38*** | (2020.01) |
| ***D06F 33/40*** | (2020.01) |
| ***D06F 34/04*** | (2020.01) |
| ***D06F 34/18*** | (2020.01) |
| ***D06F 34/20*** | (2020.01) |
| ***D06F 34/32*** | (2020.01) |
| ***D06F 39/12*** | (2006.01) |
| *D06F 103/04* | (2020.01) |
| *D06F 103/24* | (2020.01) |
| *D06F 103/26* | (2020.01) |
| *D06F 103/46* | (2020.01) |
| *D06F 105/48* | (2020.01) |
| *D06F 105/58* | (2020.01) |

(56) References Cited

FOREIGN PATENT DOCUMENTS

| | | | |
|---|---|---|---|
| KR | 10-2014-0055262 | A | 5/2014 |
| KR | 10-2016-0049367 | A | 5/2016 |
| KR | 10-2019-0104283 | A | 9/2019 |

* cited by examiner

CLOTHES HANDLING DEVICE

CROSS-REFERENCE TO RELATED APPLICATIONS

This application is a National Stage application under 35 U.S.C. § 371 of International Application No. PCT/KR2023/001673, filed on Feb. 6, 2023, which claims benefit of priority to Korean Application No. 10-2022-0014796, filed on Feb. 4, 2022. The disclosures of the prior application are incorporated by reference in their entirety.

TECHNICAL FIELD

The present disclosure relates to a laundry treating apparatus. More particularly. the present disclosure relates to a laundry treating apparatus that may check internal problems of the laundry treating apparatus and notify the outside of the problems.

BACKGROUND ART

Laundry treating apparatuses conceptually encompass apparatuses that wash laundry, apparatuses that dry laundry, and apparatuses that wash or dry laundry depending on the user's choice. Conventional laundry treating apparatuses may be divided into a front loading type in which laundry is introduced into an apparatus through a through hole provided through the front surface of the apparatus, and a top loading type in which laundry is introduced into an apparatus through a through hole provided through the upper surface of the apparatus.

When a conventional laundry treating apparatus is provided as a washing machine, the laundry treating apparatus may include a cabinet that forms the external appearance of the apparatus, a tub that stores water, a drum that is rotatably provided in the tub to accommodate laundry, and a drive part that rotates the drum.

In this laundry treating apparatus, since the drum is rotated in the state in which water is stored in the tub, strong vibration may occur. Accordingly, shock due to repeated collision of the cabinet with the ground may occur, the tub may collide with the cabinet, or one surface of the cabinet may vibrate excessively.

In addition, if there is a defect in a bearing or the like of the drive part, noise and vibration may repetitively occur whenever a rotating shaft configured to rotate the drum is rotated.

Further, if a wire or a harness that electronically controls the drive part, and the like is separated, the harness may not be fixed and may collide with the tub or the cabinet.

These defects in the laundry treating apparatus may occur frequently as four major defects, and may apply unnecessary vibration and shock to the inside of the laundry treating apparatus, thus reducing the performance and durability of the laundry treating apparatus.

Further, noise generated due to the defects may be radiated into a space in which the laundry treating apparatus is installed, and may thus cause great inconvenience to users.

Recently, laundry treating apparatuses that may detect defects in a cabinet have appeared.

Referring to Korean Patent Laid-open Publication No. 10-2021-0017702, a laundry treating apparatus detects noise during spin-drying using a microphone, and monitors collected noise data compared to specific thresholds to determine whether the noise is caused by foreign substances or eccentricity. If the magnitude and interval of the noise are more than or equal to the specific thresholds, a cycle may be stopped and a user may be notified of such a defect to take action against a problem situation.

However, this laundry treating apparatus had a problem of using only noise as an input value regardless of the weight or type of laundry, without considering driving information (RPM, imbalance, and laundry weight level) that may be obtained when driving the drive part.

Therefore, there was a problem in that presence of foreign substances and the like might not be detected in other cycles than the spin-drying cycle, and there was a fundamental limitation that the four major defects other than the presence of foreign substances might not be detected or classified.

Referring to Korean Patent Laid-open Publication No. 10-2021-001770, a laundry treating apparatus that may diagnose information about fixation, deterioration, installation errors, etc. of the laundry treating apparatus through artificial neural networks has appeared.

However, this laundry treating apparatus uses an acceleration signal but does not use a noise signal, and thus, there is a fundamental problem in that detects identified through noise may not be detected.

In addition, the laundry treating apparatus has a second artificial neural network that restores the input acceleration signal, and a first artificial neural network that performs defect diagnosis in the case that a restoration error is small. Accordingly, since the laundry treating apparatus performs defect diagnosis only when data similar to that used during training is input, there is a problem in that it is impossible to analyze various data that may occur in the actual operating situation of the laundry treating apparatus.

Therefore, the above-described laundry treating apparatus also had a fundamental problem in that it may not detect or classify defects including the four major defects, because it may not use driving information and noise, generated in the case of a defect, as input values or analyze the same.

DISCLOSURE

Technical Task

One technical task of the present disclosure is to provide a laundry treating apparatus that may detect a defect using noise generated from a cabinet or the inside of the cabinet and driving information detected by a drive part, which rotates a drum.

Another technical task of the present disclosure is to provide a laundry treating apparatus that may classify which defect a detected defect corresponds to through noise and driving information and notify the outside of the defect.

Another technical task of the present disclosure is to provide a laundry treating apparatus that has a controller configured to receive noise and driving information as input values and output whether there is a defect.

Another technical task of the present disclosure is to provide a laundry treating apparatus that, when an additional abnormal state other than recognizable and analyzable defects occurs, may collect data on the abnormal state and transmit the data to a server and the like to request analysis.

Yet another technical task of the present disclosure is to provide a laundry treating apparatus that may detect whether there is a defect and analyze the defect, even if the environment in which the laundry treating apparatus is placed changes.

Technical Solutions

In order to solve the above technical tasks, the present disclosure provides a laundry treating apparatus including a controller configured to receive a sound signal including at least one of a magnitude of noise detected by a microphone, a frequency of the noise, or a period of the noise, and driving information including a current value, rpm, a laundry weight, and eccentricity output from a drive part.

The controller may detect an abnormal state including at least one of a ground defect of a cabinet, a vibration defect of the cabinet, a driving defect of the drive part, or a fastening defect of a harness.

For example, the controller may detect the abnormal state by receiving at least one of the magnitude, period, or frequency of the noise depending on a change in the rpm of the drive part.

Further, the controller may be provided to classify the ground defect, the vibration defect, the fastening defect, and the driving defect in order of the period of the noise from longest to shortest, if the magnitude of the noise is greater than a reference value.

For example, the controller may be provided to classify the ground defect, the vibration defect, the fastening defect, and driving defect in order of the frequency of the noise from the lowest to highest, if the magnitude of the noise is greater than the reference value.

The controller may be provided to detect the driving defect if the magnitude of the noise is greater than or equal to the reference value.

The controller may be provided to detect the driving defect if the period of the noise corresponds to the rpm of the drive part.

The controller may exclude the driving defect from the abnormal state if the magnitude of the noise is greater than the reference value only in one of a laundry weight detection step, a washing/rinsing step, and a spin-drying step.

The controller may determine that the ground defect of the cabinet has occurred if the magnitude of the noise is greater than the reference value in the washing/rinsing step and the spin-drying step.

The controller may exclude the ground defect of the cabinet or the driving defect from the abnormal state if the magnitude of the noise is greater than the reference value in the spin-drying step.

The spin-drying step may include a temporary spin-drying step configured such that the drive part rotates at a resonance speed or lower to generate strong vibration, and a main spin-drying step configured such that the drive part rotates at the resonance speed or higher.

The controller may determine that the vibration defect has occurred if the noise having the magnitude greater than the reference value is generated in the temporary spin-drying step or when the drive part rotates at a third rpm, and is not generated in the main spin-drying step.

The vibration defect may occur due to collision between the cabinet and the tub.

Specifically, the vibration defect may occur due to a rear panel of the cabinet with the tub or the drive part.

The vibration defect may occur due to bending or vibration of the rear panel.

The controller may determine that the fastening defect has occurred if the noise having the magnitude greater than the reference value is generated in the temporary spin-drying step and the main spin-drying step.

Further, the laundry treating apparatus may further include a communication module provided to transmit the abnormal state detected by the controller to an external terminal or a server.

The controller may be provided to transmit the sound signal and the driving information to the server or the external terminal when the controller detects an abnormal state other than the ground defect of the cabinet, the vibration defect of the cabinet, the driving defect of the drive part, and the fastening defect of the harness.

The controller may, upon receiving the sound signal and the driving information, reproduce sound signal and driving information of the abnormal state so as to determine whether there is an abnormality.

Advantageous Effects

The present disclosure has the effect of detecting a defect using noise generated from a cabinet or the inside of the cabinet and driving information detected by a drive part, which rotates a drum.

The present disclosure has the effect of classifying which defect a detected defect corresponds to through noise and driving information and notifying the outside of the defect.

The present disclosure has the effect of providing a controller configured to receive noise and driving information as input values and output whether there is a defect.

The present disclosure has the effect of, when an additional abnormal state other than recognizable and analyzable defects occurs, collecting data on the abnormal state and transmitting the data to a server and the like to request analysis.

The present disclosure has the effect of detecting and analyzing whether there is a defect even if the environment in which the laundry treating apparatus is placed changes.

BEST MODE FOR DISCLOSURE

Hereinafter, embodiments of the disclosure will be described in detail with reference to the accompanying drawings. In the present disclosure, the same or similar components are indicated by the same or similar reference numbers even in different embodiments, and the description thereof is replaced with the first description. In the following description of the present disclosure, singular expressions encompass plural expressions unless the context clearly indicates otherwise. In addition, in describing the embodiments of the present disclosure, if it is determined that the detailed descriptions of related known technologies may obscure the gist of the embodiments of the present disclosure, the detailed descriptions will be omitted. Further, it should be understood that the accompanying drawings are provided only for ease of understanding the embodiments of the present disclosure, and the technical idea of the present disclosure is not limited by the accompanying drawings.

Figure 1:
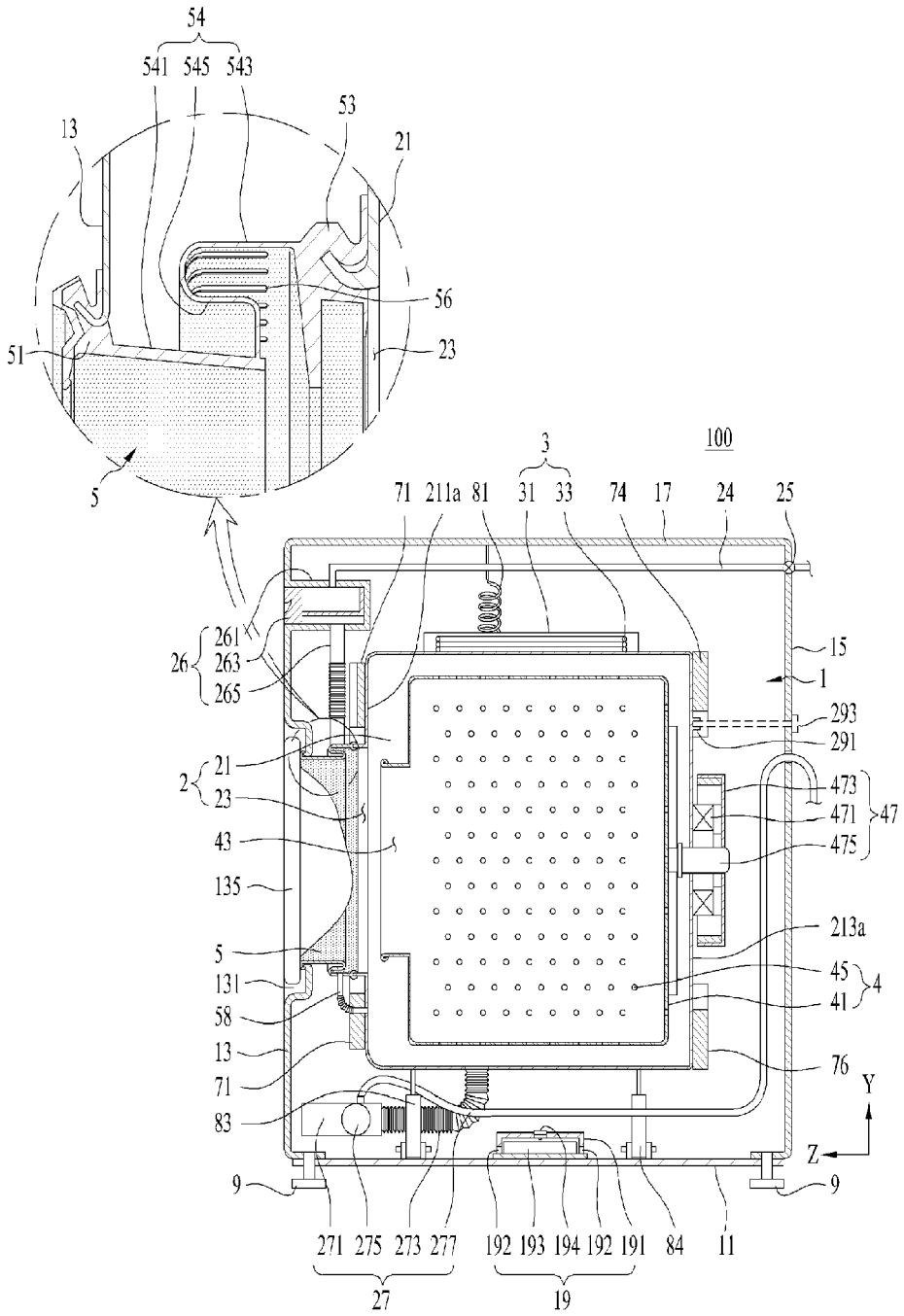
FIG. 1 shows the basic structure of a laundry treating apparatus.

As shown in FIG. 1, a laundry treating apparatus 100 of the present disclosure may include a cabinet 1, and a laundry accommodator provided in the cabinet 1 to accommodate laundry. If the laundry treating apparatus 100 is provided as a washing machine, the laundry accommodator may include a tub 2 provided in the cabinet to store water, and a drum 4 rotatably provided in the tub to accommodate the laundry. In addition, if the laundry treating apparatus 100 is provided as a clothes dryer, the laundry accommodator may include only a drum without a tub.

Hereinafter, a description will be given on the premise that the laundry treating apparatus 100 is provided as a front load-type washing machine having an opening provided through the front surface of the cabinet 1, but this is only for explanation, and the description may be applied to a case in which the laundry treating apparatus 100 is provided a clothes dryer, or a case in which the laundry treating apparatus 100 is a top load type having an opening formed through the upper surface of the cabinet 1.

The cabinet 1 may include a base 11 which forms the bottom surface of the laundry treating apparatus, a front panel 13 which forms the front surface of the laundry treating apparatus and has an opening, a rear panel 15 which forms the rear surface of the laundry treating apparatus, an upper panel 17 which forms the upper surface of the laundry treating apparatus, and a first side panel 161 (see FIG. 3) and a second side panel 163 which are fixed to the base to form the left and right side surfaces of the laundry treating apparatus, respectively.

The front panel 13 is fixed to at least one of the base 11 or the side panel 161 of 16, and the front panel 13 may be provided with an inlet 131 through which laundry enters and exits the laundry treating apparatus. The inlet 131 may be opened and closed by a door 135.

The first side panel 161, the second side panel 163, and the rear panel 15 may be provided as one body. That is, the first side panel, the second side panel, and the rear panel may be provided by bending one plate into a shape corresponding to the edge of the base 11.

The tub 2 includes a cylindrical tub body 21 having an empty interior, a front cover 211*a* fixed to the tub body to form the front surface of the tub, and a rear cover 213*a* fixed to the tub body to form the rear surface of the tub.

The front cover 211*a* may be located in a direction toward the front panel 13, and the rear cover 213*a* may be provided in a direction toward the rear panel 15. The front cover 211*a* may be provided with a tub inlet 23 communicating with the inlet 11.

The inlet 11 and the tub inlet 23 are connected through a vibration isolator 5, and the vibration isolator 5 may be formed of an elastic material, such as rubber.

The vibration isolator 5 may be provided to minimize transmission of vibration generated from the tub body 21 to the cabinet 1. The vibration isolator 5 may include a ring-shaped first fixing body 51 fixed to the inlet 131, a ring-shaped second fixing body 53 fixed to the tub inlet 23, and a connector 53 provided to connect the first fixing body 51 and the second fixing body 53 and having a shape with at least two inflection points. The connector 54 may be provided as a rubber pipe having an S-shaped cross section. That is, the connector 54 may include a pipe-shaped first extension body 541 extending from the first fixing body 51 toward the tub inlet 23, a pipe-shaped second extension body 543 extending from the second fixing body 53 toward the inlet 11, and a bending part 545 configured to connect the first extension body 541 and the second extension body 543 and having the at least two inflection points.

The thickness of the bending part 545 may be set to be smaller than the thickness of the first extension body 541 and the thickness of the second extension body 543. Even if the vibration isolator 5 is formed of an elastic material. such as rubber. the thicker the connector 54 is, the more vibration of the tub body 21 may be transmitted to the cabinet 1. Therefore, if the thickness of the bending part 545 is set to be smaller than the thicknesses of the two extending bodies 541 and 543, transmission of vibration of the tub body 21 to the cabinet may be effectively blocked.

Unlike the above description. the thickness of one of the first extension body 541 and the second extension body 543 may be set to be equal to the thickness of the bending part 545, and the thickness of the remaining one of the first extension body 541 and the second extension body 543 may be set to be greater than the thickness of the bending part 545.

FIG. 1 shows a case in that the thickness of the bending part 545 is set to be smaller than the thickness of the first extension body 541, and the thickness of the second extension body 543 is set to be equal to the thickness of the bending part 545, as an example.

However, if the thickness of the connector 54 becomes too small, the risk of tearing the vibration isolator 5 due to vibration of the tub body 21 increases, and in order to prevent this, the vibration isolator 5 may be further provided with ribs 56. The ribs 56 are provided on the second extension body 543 to reinforce the strength of the connector 54. The ribs 56 may be provided as bar-shaped protrusions provided in a direction from the second fixing body 543 toward the bending part 545. A plurality of ribs 56 having the above-described structure may be provided to be spaced apart from each other along the circumferential surface of the second extension body 543.

Meanwhile, the vibration isolator 5 having the above-described structure may not exclude a possibility that water remains in the connector 54. In order to prevent water from remaining in the vibration isolator 5, the laundry treating apparatus according to the present disclosure may further include a residual water discharge pipe 58 which guides water in the vibration isolator 5 to the tub body 21. The residual water discharge pipe 58 may be provided as a pipe connecting the second extension body 543 and the front cover 211.

One end of the residual water discharge pipe 58 may be fixed to an area located below a horizontal line H passing through the center of the second extension body in a space provided by the second extension body, and the other end of the residual water discharge pipe 58 may be fixed to an area below a horizontal line H passing through the center of the tub inlet 21 in a space provided by the front cover 211*a*. This serves to move water in the vibration isolator 5 to the tub body 21 without a separate device, such as a drain pump (see FIG. 3).

Further, the tub body 21 may receive water through a water supply, and the water stored in the tub body 21 may be discharged to the outside of the cabinet 1 through a drainage 27. The water supply may include a water supply pipe 24 connecting a water supply source and the tub body 21, and a water supply valve 25 configured to open or close the water supply pipe depending on a control signal from a controller (not shown).

If the laundry treating apparatus according to the present disclosure is provided with a detergent supply 26 configured to supply a detergent to the tub body 21. the water supply pipe 24 may be provided to supply water to the detergent supply 26.

The detergent supply 26 may include a case 261 fixed to the inside of the cabinet 1, a drawer 263 which may be withdrawn from the case to the outside of the cabinet 1, and a connection pipe 265 connecting the bottom surface of the case and the vibration isolator 5.

The drawer 263 may be provided with a storage which provides a space configured to store the detergent, and a syphon flow path provided in the storage to discharge a liquid in the storage to the case 261 when the water level in the storage exceeds a predetermined reference water level. A user may withdraw the drawer 263 from the case 261 through a drawer entrance (not shown) provided to penetrate the front panel 13.

The drainage 27 includes a chamber 271 located in the cabinet 1, a first drain pipe 273 which guides the water in the tub body 21 to the chamber 271, a pump 275 which pressurizes the water introduced into the chamber 271, and a second drain pipe 277 which guides the water discharged from the pump to the outside of the cabinet 1.

The drum 4 may be provided with a cylindrical drum body 41 having an empty interior. The front surface (the surface facing the front cover) of the drum body 41 may be provided with a drum inlet 43. The drum inlet 43 is provided at a position corresponding to the tub inlet 23 (the drum inlet is provided to communicate with the tub inlet). Accordingly, laundry supplied through the tub inlet 23 may be moved to the drum body 41 through the drum inlet 43.

The drum 4 further includes a plurality of communication holes 45 provided to penetrate the drum body 41, and the tub body 21 and the drum body 41 communicate with each other by the communication holes 45. Accordingly, the water stored in the tub body 21 may move into the drum body 41 through the communication holes 45, and the water in the drum body 41 may move to the tub body 21 through the communication holes 45.

The drum 4 is rotated by a drive part 47, and the drive part 47 may include a stator 471 fixed to the rear cover 213*a* and located outside the tub body 21, a rotor 472 rotated by a rotating magnetic field provided by the stator, and a rotating shaft 475 provided to penetrate the rear cover 213*a* to connect the drum body 41 and the rotor 473.

The laundry treating apparatus 100 of the present disclosure may further include a heater 3. The heater 3 may include a housing 31 fixed to the circumferential surface of the tub body 21, and a coil 33 fixed to the inside of the housing to generate an eddy current in the drum body 41 when current is supplied to the heater 3.

The laundry treating apparatus 100 of the present disclosure may further include fixing parts which prevent the tub body 21 from colliding with the cabinet 1 during transportation. The fixing parts serve to connect the rear cover 213*a* to the rear panel 15 of the cabinet, and may include a boss 291 provided on the rear cover 213*a*, and a fixing bolt 293 which penetrates the rear panel 15 of the cabinet and is fastened to the boss 291. When transportation is completed, the fixing bolt 293 may be separated from the cabinet 1.

The present disclosure may further include a water leakage detection sensor 19. The water leakage detection sensor 19 determines whether water supplied to the tub body 21 leaks to the base 11. The water leakage detection sensor 19 may include a cylindrical housing 191 fixed to the base 11, a plurality of inflow holes 192 which communicates an accommodation space provided in the housing with the outside, an actuator 193 located in the accommodation space, and a sensing part 194 fixed to the upper end of the housing 191. When water leaks to the base 11, the actuator 193 moves toward the upper surface of the housing 191 by the buoyancy of the water, and when the actuator 193 comes into contact with the sensing part 194, the sensing part 194 transmits a signal to the controller (not shown). In this case, the controller may stop operation of the drive part 47 and notify the user of water leakage through a display (not shown) or a speaker provided on the cabinet. The water leakage detection sensor 19 may be provided at the lowest position in a space provided by the base 11 so that water leakage may be immediately detected.

In order to increase washing power. the laundry treating apparatus according to the present disclosure may further include an injection part which injects the water stored in the tub body 21 onto the laundry through the tub inlet 23 and the drum inlet 43. The structure of the injection part will be described later.

Figure 2:
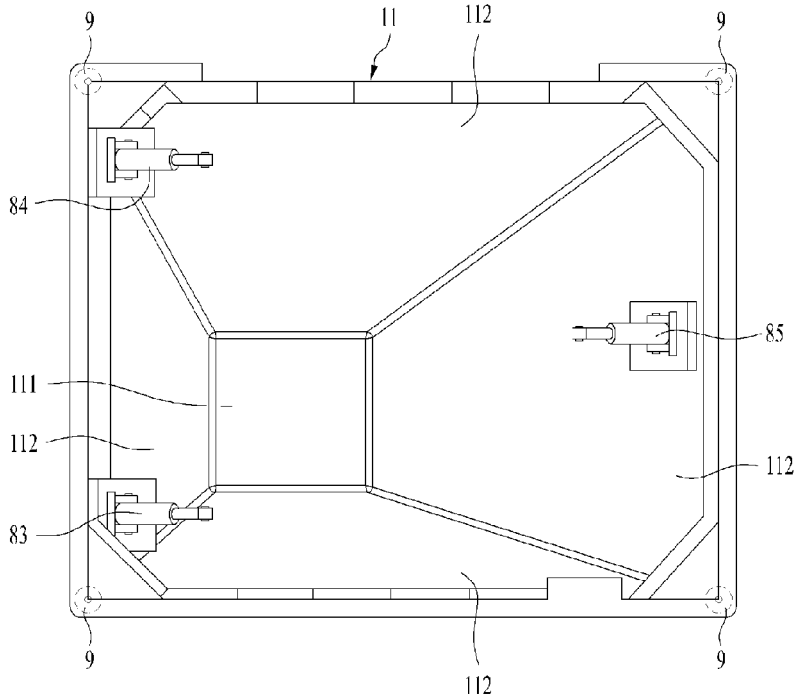
FIG. 2 shows one embodiment of a base according to the present disclosure.

FIG. 2 shows one embodiment of the base according to the present disclosure.

The base 11 may be provided with a sensor installation surface 111 and a plurality of inclined surfaces 112 inclined downward from the edge of the base toward the sensor installation surface 111. The water leakage detection sensor 19 may be provided on the sensor installation surface 111 to immediately detect water leakage.

Figure 3:
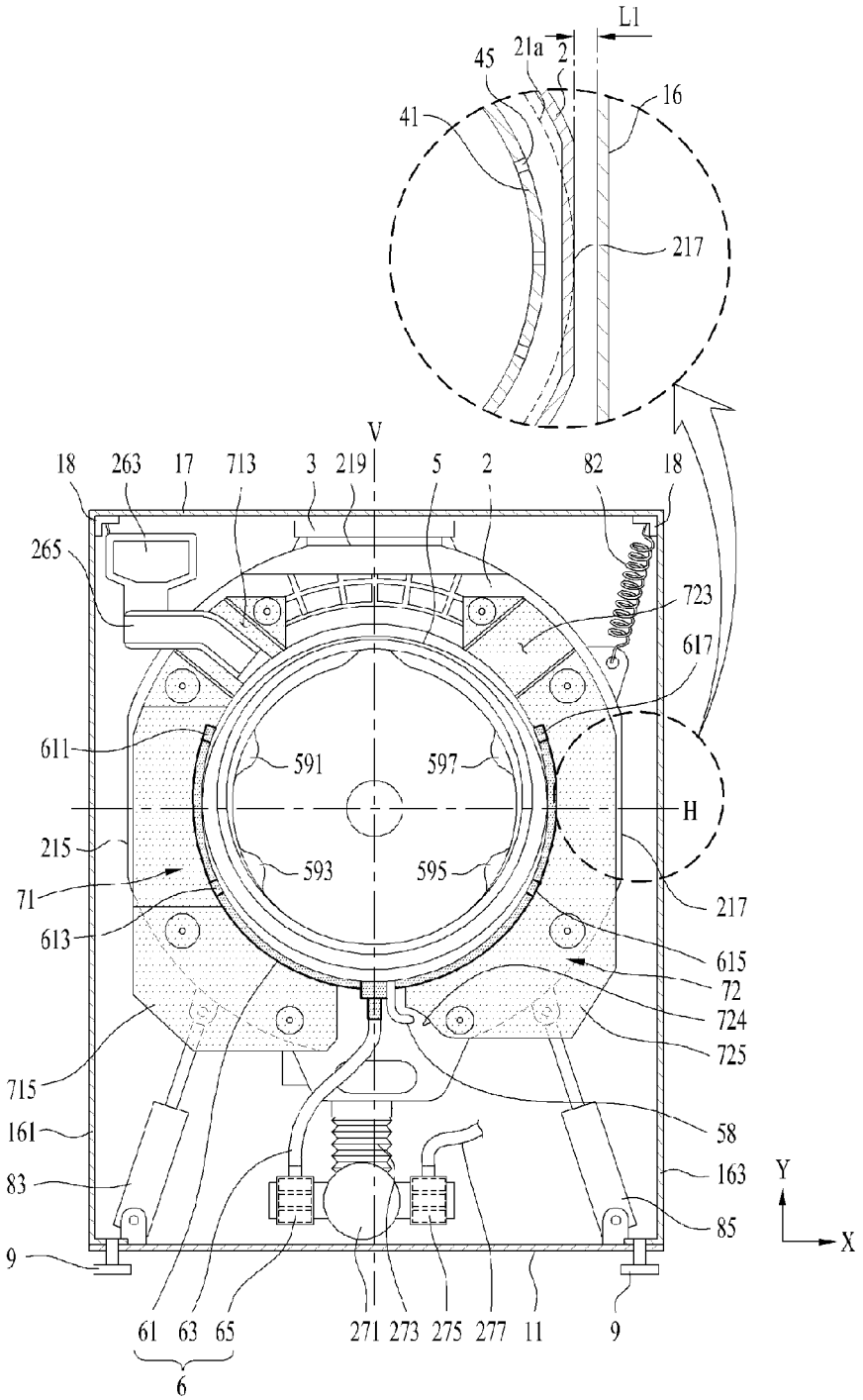
FIG. 3 shows the structure of the laundry treating apparatus viewed from the front.

FIG. 3 shows the structure of the laundry treating apparatus viewed from the front.

The tub body 21 is fixed to the inside of the cabinet 1 through tub supports 81, 82, 83, 84, and 85, and the tub supports may include elastic force providers 81 and 82, and damping parts 83, 84, and 85.

The damping parts may be provided as a plurality of dampers 83, 84, and 85 which connects an area below a horizontal line H passing through the center of the tub body 21 among the circumferential surface of the tub body 21 to the base 11. The damping parts may include a first damper 83 and a second damper 84 located on one side of a vertical line V passing through the center of the tub body 21 to connect the base 11 and the lower area of the tub body 21, and a third damper 85 located on the other side of the vertical line V to connect the base 11 to the lower area of the tub body 21. Each of the plurality of dampers 83, 84, and 85 may include a cylinder fixed to the base 11, and a piston connecting the cylinder to the tub body 21. One end of the piston is fixed to the tub body 21, and the other end of the piston is coupled to the cylinder to reciprocate in the cylinder.

The elastic providers may be provided as a first spring 81 and a second spring 82 connecting an area above the horizontal line H passing through the center of the tub body 21 among the circumferential surface of the tub body 21 to the cabinet 1. In this case, the cabinet 1 may further include frames 18 to which the respective springs are fixed. The frames 18 may be provided as a first frame provided at a corner where the first side panel 161 and the upper panel 17 meet to fix the first spring 81 thereto, and a second frame provided at a corner where the second side frame 163 and the upper panel 17 meet to fix the second spring 82 thereto.

The injection part 6 may include a flow path body 61 fixed to the front cover 211*a* of the tub body and located in spaces between the edge of the vibration isolator 5 and front load parts 71 and 72, a supply pipe 62 which guides water to the flow path body 61, and a circulation pump 65 which moves the water in the tub body 21 to the supply pipe 63 (see FIG. 3).

The flow path body 61 may be provided as a flow path provided along a space between the edge of the vibration isolator 5 and a first balancer 71 and a space between the edge of the vibration isolator 5 and a second balancer 72. The circulation pump 65 may be provided to move water in a chamber 271 provided in the drainage to the supply pipe 63.

The flow path body 61 may be provided with a first discharger 611, a second discharger 613, a third discharger 915, and a fourth discharger 617 which discharge water to the outside of the flow path body. The first discharger 611 and the second discharger 613 may be provided on the left side of the vertical line V passing through the center of the tub inlet 23, and the third discharger 615 and the fourth discharger 617 may be provided on the right side of the vertical line V.

The first discharger 611 may be connected to a first guide 591 provided on the vibration isolator, the second discharger 613 may be connected to a second guide 593 provided on the vibration isolator, the third discharger 615 may be connected to a third guide 595 provided on the vibration isolator, and the fourth discharger 617 may be connected to a fourth guide 597 provided on the vibration isolator. The guides 591, 593, 595, and 597 guide water supplied from the respective dischargers 611, 613, 615, 617 in a direction where the drum inlet 43 is located.

Further, in the laundry treating apparatus according to the present disclosure, the tub 3 may be provided to expand toward the cabinet 1. This serves to expand the volume of the tub so as to expand the volume of the drum, and to maximize a laundry treating capacity. Specifically, the tub may be provided to have a larger diameter so as to be closer to the cabinet.

The tub may be provided in a cylindrical shape. and the cabinet may be provided in a hexahedral shape. Accordingly, since the parts of the cabinet corresponding to corners or vertexes are farther away from the center of the tub, the tub may be further expanded toward the corners or the vertexes. However, since the inner surfaces of the cabinet, such as the side panels or the upper panel, are close to the center of the tub, expansion of the tub to the corners of the cabinet may be limited by the inner surfaces of the cabinet.

Therefore, the tub according to the present disclosure may be provided so that the portions thereof facing the inner surfaces of the cabinet are flat and the remaining portions thereof are provided in a circular shape to expand the volume of the tub as much as possible.

That is to say, the diameter of the portions of the tub body 21 facing the side panels 161 and 163 of the cabinet and the upper panel 17 of the cabinet may be different from the diameter of the portions of the tub body 21 facing the corners of the cabinet.

The corners may correspond to portions of the cabinet where the front panel 13 comes into contact with the first side panel 161 and the second side panel 163, portions of the cabinet where the upper panel 17 comes into contact with the first side panel 161 and the second side panel 163, etc.

Specifically, a first flat surface 215 and a second flat surface 217 forming planes perpendicular to the base 11 may be provided on the circumferential surface of the tub body 21. The first flat surface 215 may be provided on an area facing the first side panel 161 among the circumferential surface of the tub body 21, and the second flat surface 217 may be provided on an area facing the second side panel 163 among the circumferential surface of the tub body 21.

The fact that the first flat surface 215 is provided to be perpendicular to the base 11 means that an angle between the first flat surface 215 and the base 11 in the height direction (Y-axis direction) of the cabinet 1 is 90 degrees within an error range that occurs when manufacturing the tub body 21. The first flat surface 215 and the second flat surface 217 are provided to be perpendicular to the base 11 in order to maximize the volume of the tub body 21 installed in the cabinet having a limited volume.

When the drum body 41 is rotated by the drive part 47, vibration generated from the drum body 41 may be transmitted to the tub body 21 through the rotating shaft 475. Therefore, a conventional tub body 21*a* minimizes transmission of vibration of a tub to a cabinet 1 by ensuring that a distance between the circumferential surface of the tub body and the cabinet 1 is greater than or equal to a predetermined reference distance L1.

If the first flat surface 215 and the second flat surface 217 are provided on the circumferential surface of the tub body 21. the present disclosure may provide a tub body having a greater volume than the conventional tub body. If a distance between the first flat surface 215 and the first side panel 161 and a distance between the second flat surface 217 and the second side panel 163 are set to the reference distance L1. the diameter of the tub body 21 may be set to be greater than the diameter of the conventional tub body 21*a*.

The first flat surface 215 provided in the present disclosure may not only be perpendicular to the base 11 but also be parallel to the first side panel 161, and the second flat surface 217 may not only be perpendicular to the base 11 but also be parallel to the second side panel 163.

In addition, a third flat surface 219 to which the housing is fixed may be further provided on the area above the horizontal line H passing through the center of the tub body 21 among the circumferential surface of the tub body 21. This serves to increase the efficiency of the heater 8 by minimizing a distance between the coil 33 and the drum body 41. The third flat surface 219 may be provided parallel to the base 11. or may be provided obliquely to the base 11.

Meanwhile, the tub may be provided with load parts 7, which apply a load to the tub, outside the tub inlet 23 or outside the drive part 27. Thereby, the weight of the tub 2 is increased and thus the amplitude of vibration may be reduced. and even if the distance between the tub 2 and the cabinet 1 is decreased. collision between the tub 2 and the cabinet 1 may be prevented. The detailed structure of the load parts 7 will be described later.

Figure 4:
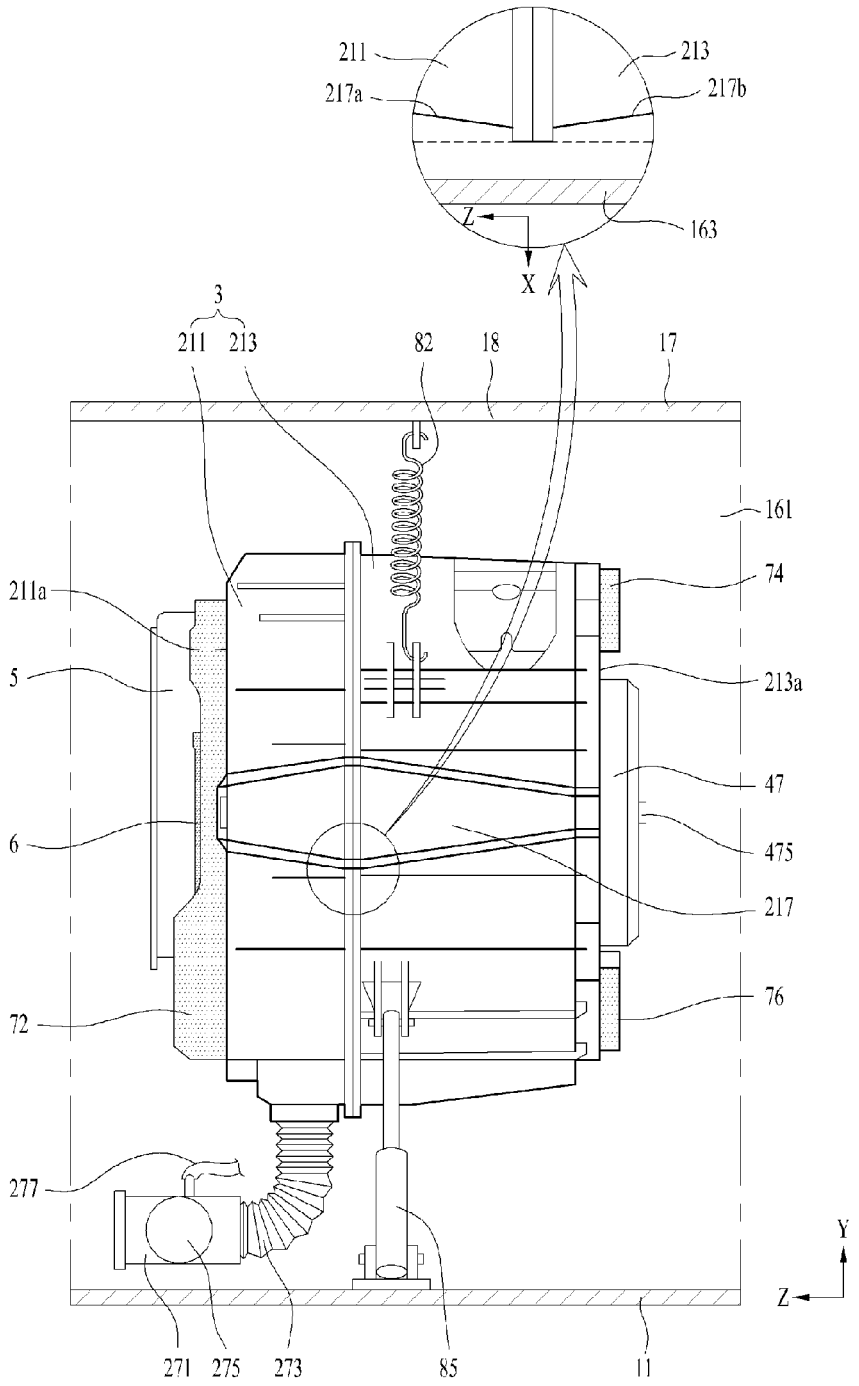
FIGS. 4 and 5 show a tub structure according to one embodiment of the present disclosure.
Figure 5:
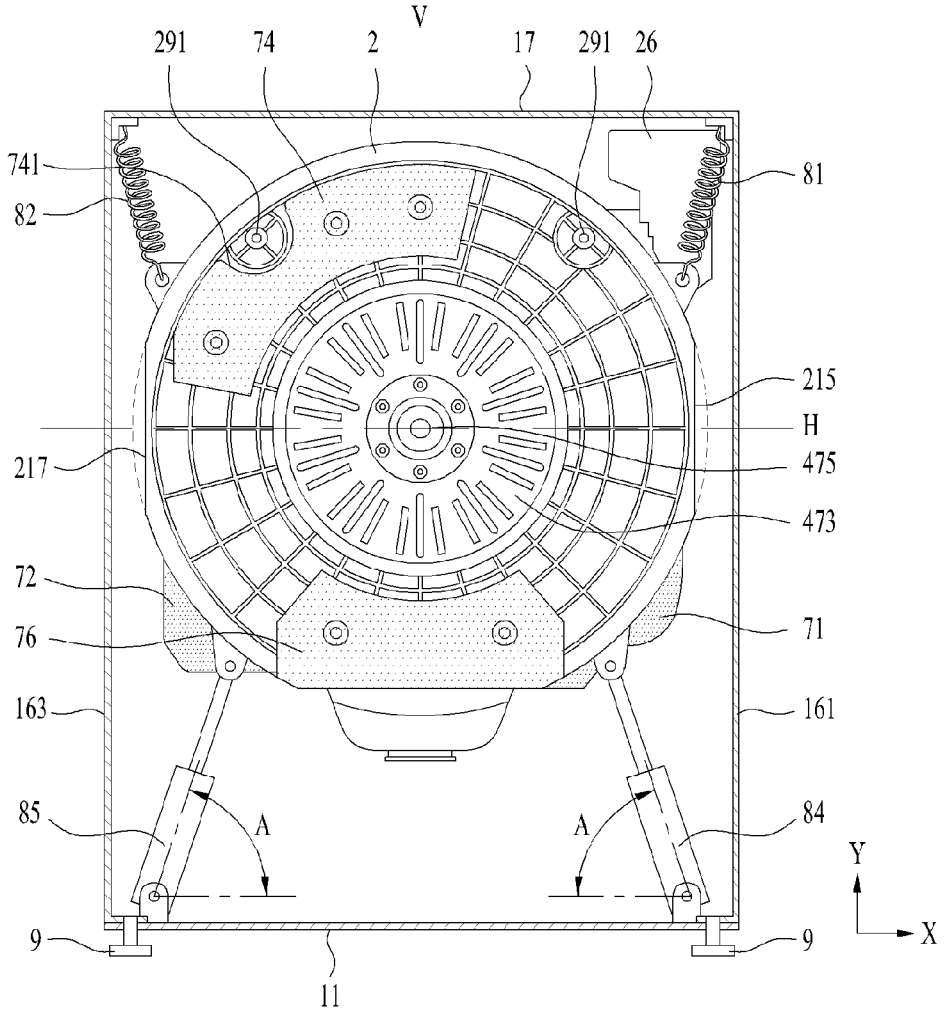

FIGS. 4 and 5 shows a tub structure according to one embodiment of the present disclosure.

FIG. 4 shows the tub viewed from the side, and FIG. 5 shows the tub viewed from the front.

The tub body 21 may include a first tub body 211 and a second tub body 213. When molding the tub body 21 through injection molding, it is better to produce the tub body 21 by combining two cylindrical bodies 211 and 213 having one side open than to mold the tub body 21 as a single body. In this case, the front cover 211*a* and the tub inlet 23 must be formed on the first tub body 211, and the rear cover 213*a* must be provided on the second tub body 213.

When the tub body 21 includes the first tub body 211 and the second tub body 213, the second flat surface 217 may include a first surface 217*a* provided on the first tub body 211 and a second surface 217*b* provided on the second tub body 213, and the first flat surface 215 may include a first surface (not shown) provided on the first tub body 211 and a second surface (not shown) provided on the second tub body 213.

When the first tub body 211 and the second tub body 213 are molded through injection molding, the first flat surface 215 may be provided orthogonally to the base 11 but not parallel to the first side panel 161, and the second flat surface 217 may be provided orthogonally to the base 11 but not parallel to the second side panel 163.

In order to mold the first tub body 211. the second tub body 213, the first flat surface 215, and the second flat surface 217 through injection molding, the first flat surface 215 must be provided obliquely to the first side panel 161, and the second flat surface 217 must be provided obliquely to the second side panel 163. This serves to enable easy separation of injection-molded products (the first tub body and the second tub body) from molds.

That is, the first surface 217*a* of the second flat surface is inclined in a direction away from the second side panel 163 as it approaches the front cover 211*a*, and the first surface of the first flat surface 215 is inclined in a direction away from the first side panel 161 as it approaches the front cover 211*a*. Further, the second surface 217*b* of the second flat surface is inclined in the direction away from the second side panel 163 as it approaches the rear cover 213*a*, and the second surface of the first flat surface 215 is inclined in the direction away from the first side panel 161 as it approaches the rear cover 213*a*.

The distance between the first flat surface 215 and the first side panel 161 and the distance L1 between the second flat surface 217 and the second side panel 163 may be reduced by minimizing vibration generated from the tub body 21. That is, when the vibration generated from the tub body 21 is minimized, the volume of the tub body 21 may be further increased.

Unlike conventional laundry treating apparatuses, the present disclosure may be provided with the load parts 7 on the front cover 211*a*, which forms the front surface of the tub body, and the rear cover 213*a*, which forms the rear surface of the tub body, to increase the weight of the tub body. When the weight of the tub body is increased, a large amount of energy is required to vibrate the tub body (the tub body does not vibrate easily). Accordingly, the present disclosure may minimize vibration generated from the tub body 21, and thus, may minimize the distance between the first flat surface 215 and the first side panel 161 and the distance L1 between the second flat surface 217 and the second side panel 163 (i.e., may maximize the volume of the tub body).

For this purpose, the load parts 7 of the laundry treating apparatus according to the present disclosure may further include the front load parts 71 and 72 fixed to the front cover 211*a* to increase the weight of the tub body 21, and rear load parts 74 and 76 fixed to the rear cover 213*a* to increase the weight of the tub body 21.

The front load parts may include the first balancer 71 fixed to the front cover 211*a* and located on the left side of the vertical line V passing through the center of the tub inlet 23, and the second balancer 72 fixed to the front cover 211*a* and located on the right side of the vertical line V (see FIG. 3).

The rear load parts may include a third balancer 74 fixed to an area above the horizonal line H passing through the center of the tub body 21 in a space provided by the rear cover 213*a*, and a fourth balancer 76 fixed to an area below the horizonal line H passing through the center of the tub body 21 in the space provided by the rear cover 213*a* (see FIG. 4).

In order to minimize vibration generated from the tub body 21 (to maximize the volume of the tub body), the plurality of dampers 83, 84, and 85 provided in the damping parts may be provided as shown in FIG. 5. That is, the plurality of dampers 83, 84, and 85 may be provided to have an inclination angle A of 69 to 71 degrees with respect to the base 11.

If the inclination angle A of each damper with respect to the base 11 is too small. the vibration amplitude in the height direction (Y-axis direction) of the tub body increases, if the inclination angle A of each damper is close to 90 degrees, the vibration amplitude in the left and right directions (X-axis direction) of the tub body increases, and if the inclination angle A of each damper is within the range of 69 degrees to 71 degrees, the vibration amplitude in the height direction and the vibration amplitude in the left and right directions of the tub body may be minimized.

Even though the vibration generated from the tub body 21 is minimized, if the vibration of the tub body 21 is easily transmitted to the cabinet 1, it is difficult to minimize the distance between the first flat surface 215 and the first side panel 161 and the distance L1 between the second flat surface 217 and the second side panel 163.

Figure 6:
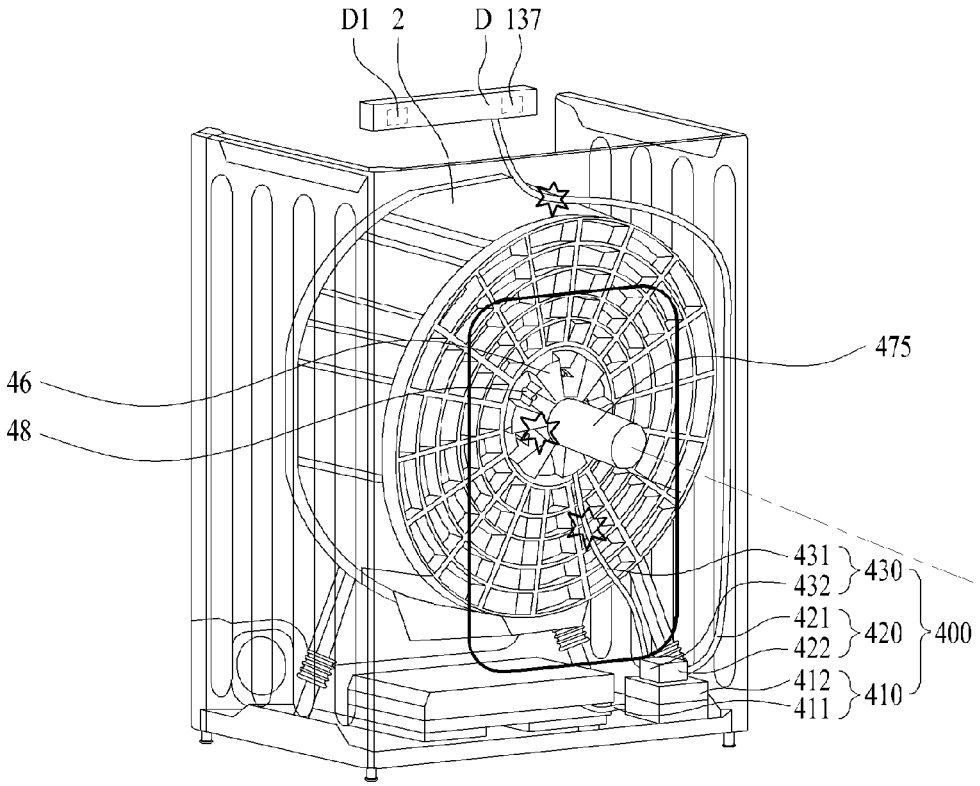
FIG. 6 shows an embodiment in which a control panel or a harness of a display panel or a drive part are coupled.

FIG. 6 shows an embodiment in which a control panel or a harness of a display panel or the drive part are coupled.

In general, a display part, which displays the state of the laundry treating apparatus, may be installed on the upper or front surface of the cabinet, and installed at a display panel D(=display control panel), which controls the display part, may be installed. The display panel D may be provided adjacent to the display part.

Meanwhile, the laundry treating apparatus according to the present disclosure may include the controller, which controls the drive part 47, the water supply 24 and 25, the drainage 27, and the like.

The controller 300 may control one or more of the drive part 47, the water supply 24 and 25, and the drainage 27 to perform an arbitrary course to wash or dry laundry. The arbitrary course may include a series of control methods that perform a washing cycle to separate foreign substances from the laundry using water and detergent, a rinsing cycle to remove the water and the foreign substances from the laundry, and a spin-drying cycle to remove moisture from the laundry.

The controller 300 may be installed on the display panel D. Accordingly, the display panel D may serve as a control panel.

However, the controller 300 in the form of a control panel or a control box may be installed on the base, and may be disposed at the rear portion of the base.

As a result, the controller 300 may be disposed closer to the drive part 47 compared to the case in which the controller 300 is installed on the display panel D, and may quickly control the drive part 47.

Of course, the controller 300 may be fixed to the side panel, and may be provided in any configuration as long as it may control the internal components of the laundry treating apparatus.

The display panel D may be provided with an input part configured to input a command to execute the course, etc. to the controller.

Meanwhile, the laundry treating apparatus according to the present disclosure may further include a microphone 137 which may detect all noise generated from the laundry treating apparatus and transmit the detected noise to the controller 300. The microphone 137 may be provided to receive vibration or noise generated from the cabinet 1 itself or vibration or noise generated from the inside of the cabinet 1.

The microphone 137 may convert noise generated from the laundry treating apparatus into a sound signal and transmit the sound signal to the controller 300.

The microphone 137 may be provided on the display panel D, or may be installed anywhere, such as being separately fixed to the cabinet 1, as long as it may receive noise generated from the laundry treating apparatus.

The laundry treating apparatus according to one embodiment of the present disclosure may include a harness part 400 which may electrically connect the controller 300 to one or more of the display panel D or the drive part 47, and the microphone 137.

The harness part 400 may include wires extending from the controller 300 to the display panel D or the drive part 47, and the microphone 137, and couplers provided at the free ends of the wires to couple the wires. A known wire coupling structure may be applied as the detailed structure of the harness part 400.

The harness part 400 may include a display harness 420 extending from the display panel D to one side or the rear surface of the tub to communicate with the controller 300.

The harness part 400 may include a drive harness 430 extending from the drive part 47 to communicate with the controller 300.

The display harness 20 and the drive harness 430 may be directly coupled to the controller 300. However, the harness part 400 may additionally include a hub harness 410 configured to transmit all electrical signals to the controller 300 at once.

The display harness 420 and the drive harness 430 may be coupled to the hub harness 410) so as to be indirectly connected to the controller 300.

The controller 300 and the hub harness 410 may be fixed to the base.

The display harness 420 and the drive harness 430 may also be fixed to each other or stacked to be fixed.

For example, the display harness 420 may be stacked on and coupled to the hub harness 410, and the drive harness 430 may be stacked on and coupled to the display harness 420.

Thereby, it is possible to prevent the harness part 400 from separately vibrating in the cabinet 1, and even if vibration is transmitted to the harness part 400, it is possible to prevent the display harness 420 and the hub harness 410 from being separated from each other.

The display harness 420 may include a display wire 421 extending from the display panel D, and a display detachable part 422 coupled to the free end of the display wire 42.

The main harness 410 may include a main wire 411 extending from the controller 300, and a main detachable part 412 coupled to the free end of the main wire 411.

The drive harness 430 may include a drive wire 431 extending from the drive part 47, and a drive detachable part 432 coupled to the free end of the drive wire 431.

At least one of the drive detachable part 432 or the display detachable part 422 may be detachably coupled to the main detachable part 412.

A bearing housing 46 which rotatably supports the rotating shaft 475 may be provided on the rear surface of the tub 2 or the rear cover 213*a*.

The bearing housing 46 may be fixed to the rear cover 213*a* of the tub by injection molding when manufacturing the tub 2.

The bearing housing 46 may be formed of a metal material having greater rigidity than resin materials, and may rotatably accommodate and support the rotating shaft 475. Thereby, even if the rear cover 213*a* of the tub is formed of a material, such as plastic, damage to the bearing housing due to vibration or shock transmitted from the rotating shaft 475 may be prevented.

The bearing housing 46 may be more firmly coupled to the tub 2 by a fastening member 47. Further, the stator 471 may be coupled to the bearing housing 46 and fixed to the tub 2. The stator 471 and the bearing housing 46 may be coupled by the fastening member 47.

Figure 7:
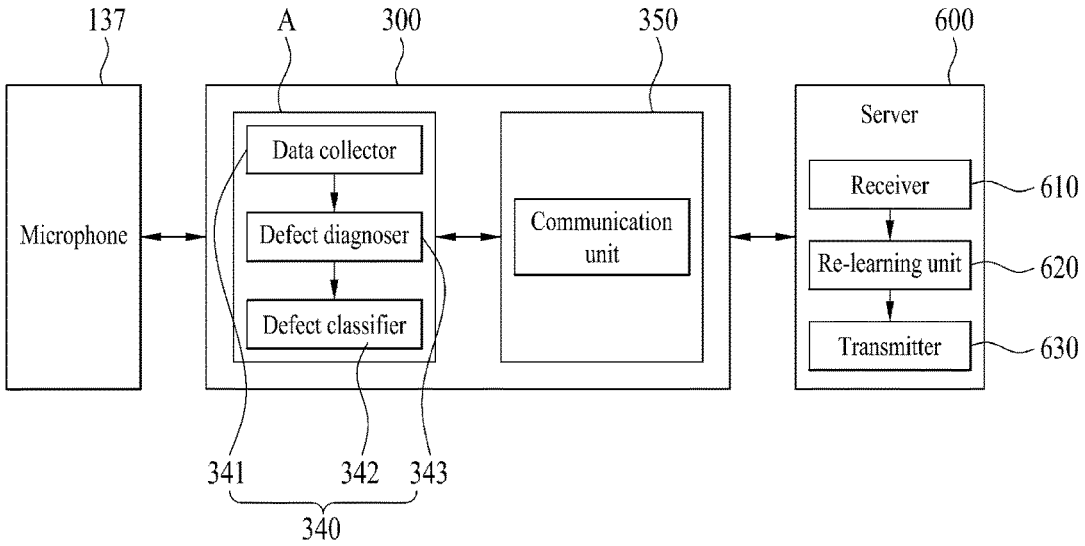
FIG. 7 shows utilization of a controller of the laundry treating apparatus according to the present disclosure.

FIG. 7 shows utilization of the controller of the laundry treating apparatus according to the present disclosure.

The laundry treating apparatus according to the present disclosure may further include a communication module 350. The communication module 350 may be provided to communicate with a server 600, and may be provided to transmit information received from the server 600 to the controller 300.

The controller 300 may be provided to not only receive information from the communication module 350, but also to control the communication module 350 to transmit information to the server 600.

The communication module 350 may be provided integrally with the controller 300, and may be separated from the controller 300 and then be communicatively coupled to the controller 300.

The communication module 350) may be provided as a Wi-Fi module or the like to communicate directly with the server 600, or may be provided to indirectly communicate with the server 600 through connection to a router placed around the laundry treating apparatus.

The controller 300 may be provided not only to control the microphone 137 and the drive part 47, but also to receive a sound signal generated from the microphone 137 and driving information output from the drive part 47 and analyze the same.

The sound signal is a signal generated by data-processing noise received by the microphone 137, and may be an electrical signal including one or more of the period, frequency, and magnitude of the noise.

The driving information may include the rpm. eccentricity (the degree of imbalance) of the rotating shaft 475 or the drum 4, and the amount of current applied or output to the stator 471. In addition, since the controller 300 may detect the weight of laundry through the amount of current, the driving information may be considered to include the weight of laundry.

Further, since the controller 300 also controls the water supply and the drainage, the controller 300 may receive cycle information regarding a water supply amount, a drainage amount, and a water level inside the tub 2.

Here, since the rpm of the drive part 47 or a point in time when the drive part 47 is operated and a point in time when the drive part 47 is stopped are controlled depending on the water level in the tub 2, the washing cycle, the rinsing cycle, and the spin-drying cycle, the driving information may be considered to include the cycle information.

The controller 300 may include a data collector 341 which receives the noise information, the driving information, and the cycle information, a defect diagnoser 342 which diagnoses whether a defect has occurred in the laundry treating apparatus through an operation value received or processed by the data collector 341, and a defect classifier 343 which analyzes which abnormal state the diagnosed defect corresponds to.

Accordingly, the controller 300 may analyze whether there is a defect in the laundry treating apparatus and what kind of defect it is through the information received from one or more electronic products controlled by the controller 300, such as the microphone and the drive part.

When the controller 300 recognizes the defect, the controller 300 may transmit the defect to the display panel D provided with the display to notify the outside of such a defective state. In addition, if the controller 300 is able to classify the defect, a kind of defect may be displayed on the display panel D.

Meanwhile, the controller 300 may provide data received from the electronic products to the server 600 through the communication part 350.

The server 600 may be a public server or a server provided by a manufacturer of the laundry treating apparatus. The server 600 may have a deep learning function that receives data from a plurality of controllers 300 and learns using the data, and may learn and analyze defects that occur in various situations by receiving the data.

Accordingly, a program capable of detecting defects may be periodically created and transmitted to the controller 300.

The controller 300 may recognize whether a defect has occurred and classify the defect using information received through the program.

For example, the controller 300 may receive a sound signal and driving information to reproduce a signal, and check whether it matches defective state or normal state data provided by the server 600 to check for an abnormal state.

For example, the controller 300 may receive a sound signal and driving information, and check whether they meet defect conditions provided by the server 600 to check for an abnormal state.

The server 600 may include a receiver 610 which receives information from the controller 300, a re-learning part which collects the received information and re-learns it, and a transmitter 630 which may organize the re-learned data and re-transmit the data to the controller 300.

Accordingly, the server 600 may collect big data from the controllers 300 installed in a plurality of laundry treating apparatuses, analyze and learn the data, and transmit data regarding various defects to the controller 300.

Therefore, if the controller 300 detects a defect or an abnormal state but cannot recognize what kind of defect it is, the controller 300 may transmit data to the server 600 to determine what kind of defect it is.

In addition, even if the controller 300 does not recognize a defective state, the server 60 may recognize whether a defect occurs through data received from the controller 300, analyze the defect, and transmit analysis results back to the controller 300. Accordingly, the controller 300 may recognize the defective state and notify the display panel D of the defective state.

Figure 8:
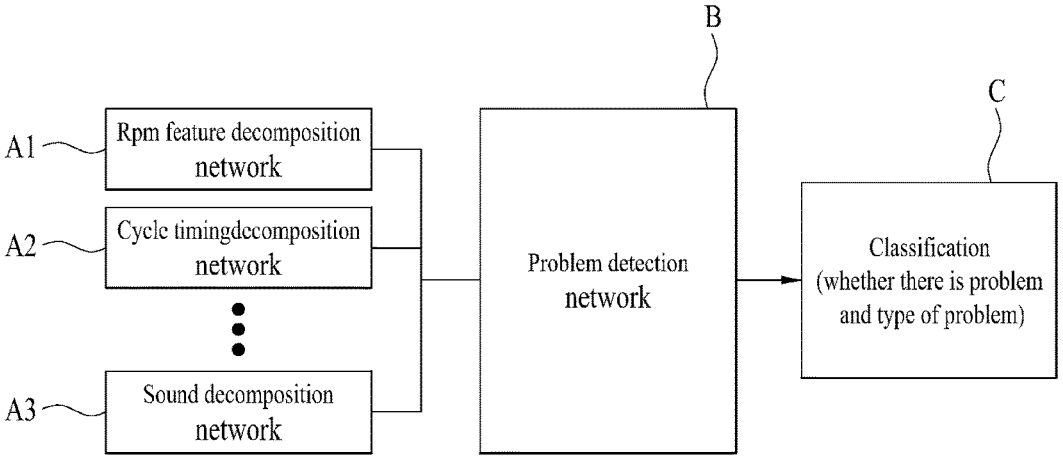
FIG. 8 shows an embodiment in which the controller (300) detects an abnormal state.

FIG. 8 shows an embodiment in which the controller 300 detects an abnormal state.

The controller 300 may include an RPM analysis program A1 that analyzes RPM characteristics to classify a change in RPM or the magnitude of RPM when receiving the sound signal and the driving information.

In addition, the controller 300 may include a cycle timing analysis program A2 that analyzes which one of the washing cycle, the rinsing cycle, and the spin-drying cycle a point in time when the controller 300 receives the sound signal and the driving information corresponds to.

Further, the controller 300 may include a sound analysis program A3 that analyzes one or more of the period, frequency, and magnitude of the sound signal received from the microphone 137.

These analysis programs A1, A2, and A3 may be installed in the data collector 341. Thereby, the controller 300 may receive one or more of the sound signal, the driving information, and the cycle information as input values.

The controller 300 may include a problem detection program B that detects an abnormal state different from the normal state from the input values. For example, in the detection program B. an acceptable threshold may be set at each point in time, and it is determined that an abnormal state exists when there is information exceeding the threshold among received and processed information. The detection program B may be installed in the defect diagnoser 342.

The controller 300 may include a classification program C that, when an abnormal state is detected by the detection program B, classifies what kind of abnormal state the abnormal state is. The classification program C may store defect data that appears when various abnormal states occur at each point in time.

The classification program C may analyze the kind of defect by matching information detected as an abnormal state by the defect diagnoser 342 with the defect data. The classification program C may be installed in the defect classifier 343.

As a result, the controller 300 may analyze information received at each point in time, detect an abnormal state that occurs at each point in time, and classify the abnormal state.

Further, the controller 300 may be provided to detect an abnormal state using deep learning or machine learning. Thereby, it possible to accurately detect and classify the abnormal state by receiving one or more of a sound signal, driving information, and cycle information which may vary depending on changes in the weight of laundry, occurrence of imbalance, a cabinet placement inclination. and the environment in which the cabinet is installed.

Accordingly, the RPM analysis program A1 may be provided as an RPM analysis network, the cycle timing analysis program A2 may be provided as a cycle timing analysis network, and the sound analysis program A3 may be provided as a sound analysis network.

In addition, the detection program B may be provided as a detection network, and the classification program C may be provided as a classification network. For this purpose, the controller 300 may be provided as a parallel operation device, and may further include a storage which may process or store various networks.

Figure 9:
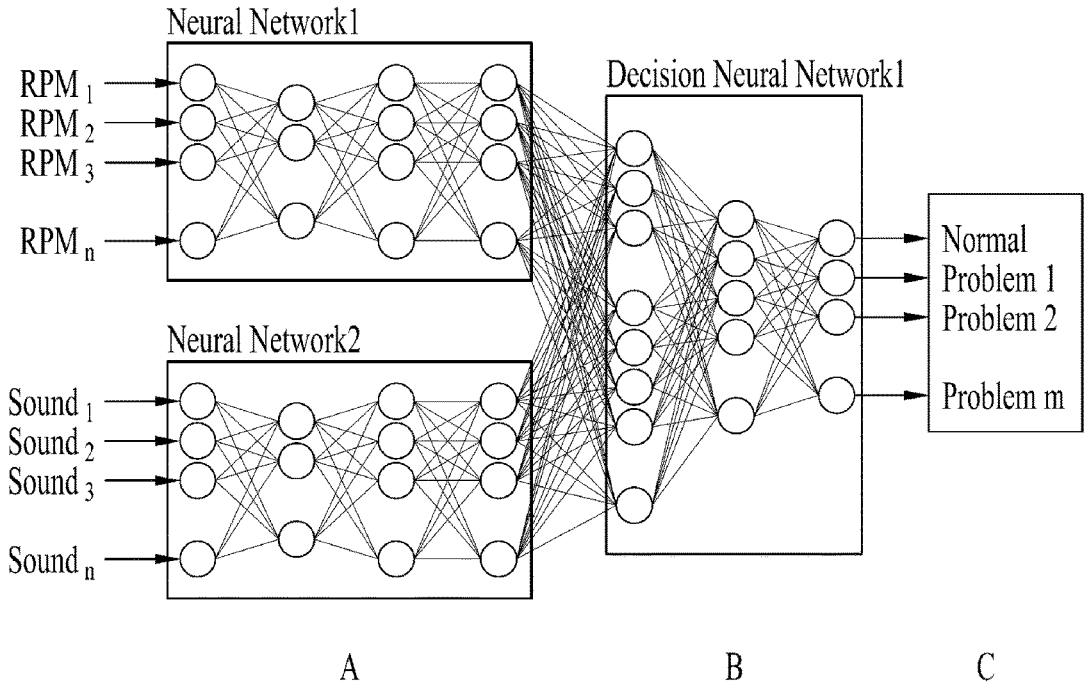
FIG. 9 is an embodiment in which the controller of the laundry treating apparatus according to the present disclosure detects a defect using deep learning.

FIG. 9 is an embodiment in which the controller of the laundry treating apparatus according to the present disclosure detects a defect using deep learning.

The controller 300 of the laundry treating apparatus according to the present disclosure may implement artificial neural network learning logic that generates an artificial neural network. The artificial neural network may be used to derive one consistent result by combining and analyzing a plurality of factors. Accordingly, the controller 300 may derive an output value by receiving two or more signals, unlike conventional controllers that may derive only one output value from one input value.

For example, the controller 300 may have the RPM analysis network A1 provided as a neural network as shown in this figure, and may comprehensively analyze RPM. an RPM waveform, a current value or a current waveform, the magnitude of vibration, etc.

In addition, the controller 300 may have the sound analysis network A2 provided as a neural network as shown in this figure, and may analyze a sound signal, such as the magnitude, period and frequency of sound.

Further, the controller 300 may have the classification network B provided as a decision neural network that may mix and process the sound signal and driving information.

The classification network C may identify the abnormal state of the laundry treating apparatus including the four major defects, which are new factors, from the result classified by the decision neural network B.

In general, the sound signal to be input to the controller P occurs dependently on the driving information. Accordingly, if the decision neural network of the controller 300 includes a sound signal depending on driving information in the normal state or sound signals depending on driving information in various abnormal states, when the sound information and driving information received from the laundry treating apparatus are inverted or reproduced by the artificial neural network, the normal or defective state of the laundry treating apparatus may be recognized and classified.

Figure 10:
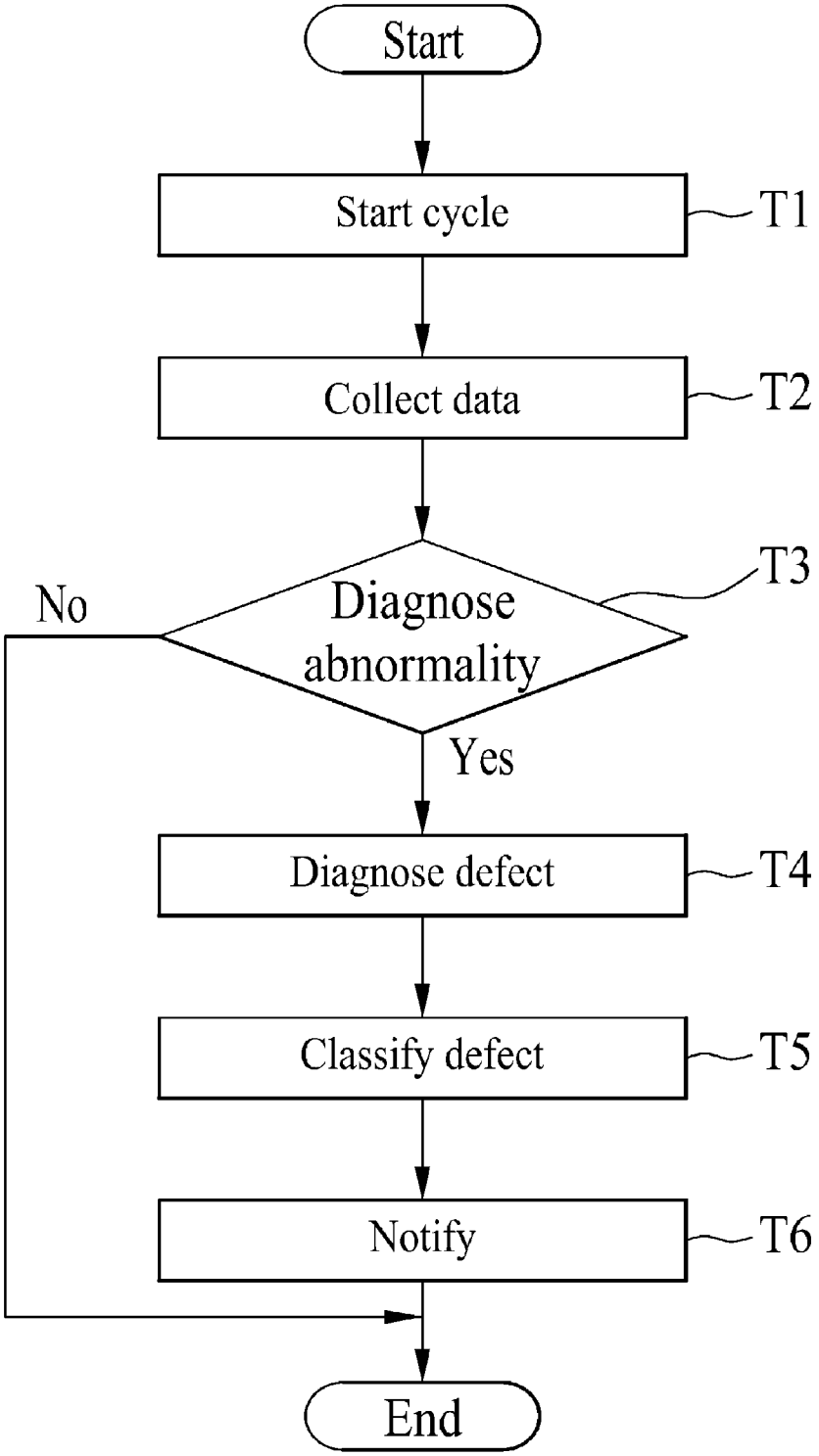
FIG. 10 shows a control method of diagnosing a defect in the laundry treating apparatus according to the present disclosure.

FIG. 10 shows a control method of diagnosing a defect in the laundry treating apparatus according to the present disclosure.

The laundry treating apparatus according to the present disclosure may perform a cycle start step T1 of performing one course among arbitrary courses.

When the cycle start step T begins. the controller 300 may perform an information collection step T2 of collecting information from one or more of the microphone 137, the drive part 37, the water supply valve 25, and the drainage 27.

The controller 300 may perform an abnormality diagnosis step T3 of determining whether or not there is an abnormality in one or more of a sound signal. driving information, and cycle information collected in the data collection step T2.

If an abnormal state is not detected during the data collection step T2 or until the end of the course, the defect diagnoser 342 may stand by until the course is terminated.

However, if the defect diagnoser 342 detects information deviating from the normal state, the defect diagnoser 342 may perform a diagnosis step T4 of diagnosing that there is a defect. In the diagnosis step T4, not only whether there is a defect may be diagnosed but also the type of the defect may be classified.

However, in the diagnosis step T4, only whether there is a defect may be determined, and the defect may not be classified. An abnormal state is a situation that exceeds a threshold based on the normal state, and may thus be easily detected, but it may be relatively difficult to analyze what defect has occurred. Therefore, it is possible to immediately detect an abnormal state and notify the outside of occurrence of the abnormal state through the display or an external terminal to take immediate action or to stop step of the laundry treating apparatus. thereby preventing a safety incident.

Thereafter, the abnormal state may be continuously analyzed or may be identified through assistance of the server 600.

Further, when the abnormal state is detected. the controller 300 may perform a defect classification step T5 of detecting which component has caused a problem or which defect has occurred.

If the kind of defect is determined in the defect classification step T5, a notification step T6 of displaying the kind of defect on the display may be performed.

Figure 11:
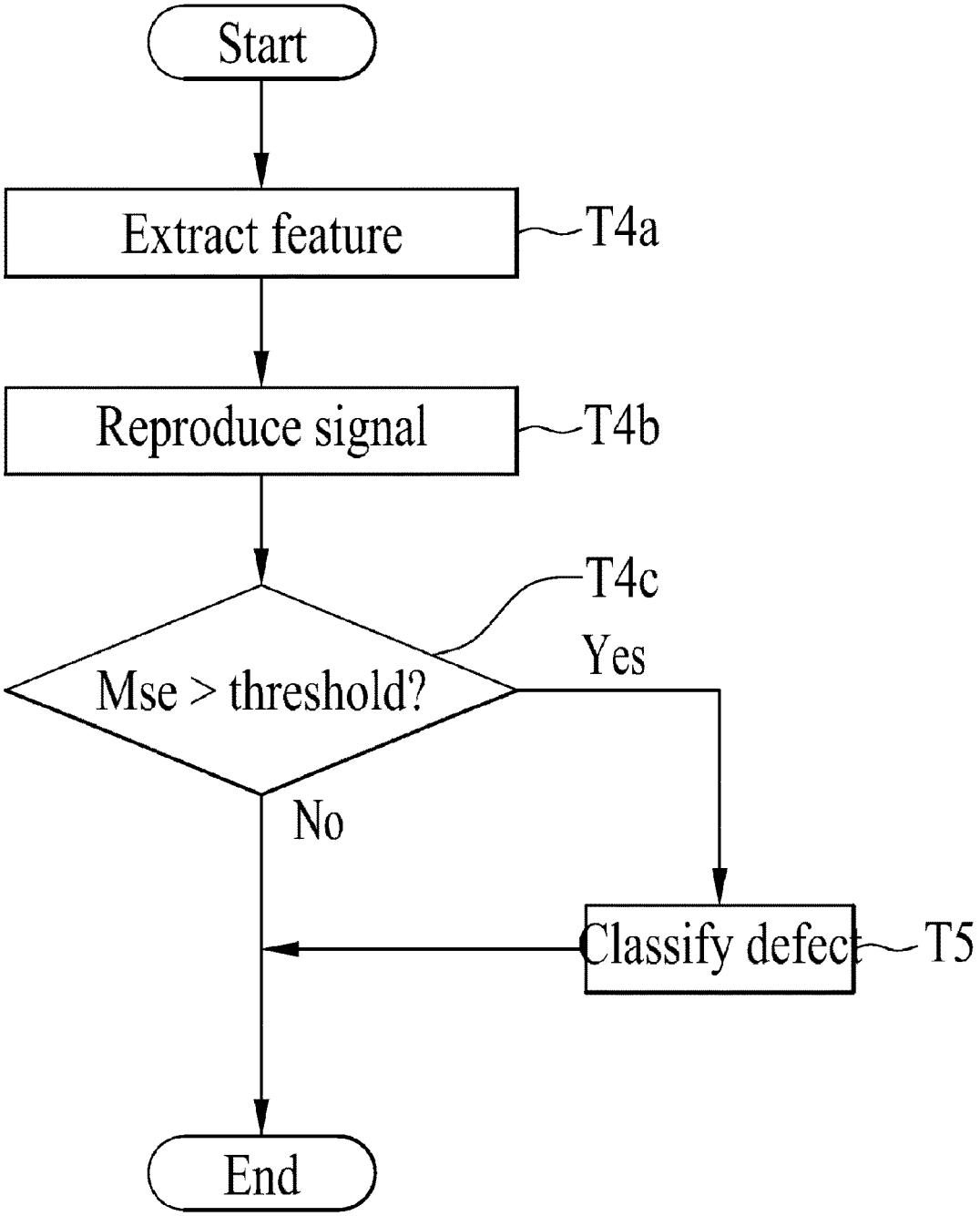
FIG. 11 shows an embodiment in which the controller diagnoses a defect. (T4)

FIG. 11 shows an embodiment in which the controller diagnoses a defect. (T4)

As described above, the laundry treating apparatus according to the present disclosure performs the diagnosis step T4, when the abnormal state is detected during the course.

When the diagnosis step T4 is performed, the defect diagnoser 342 may perform an extraction step T4*a* of extracting features from one or more of the sound signal, the driving information, and the cycle information through the analysis program A.

The extraction step T4 is an step of extracting an input value to be input to the classification program B, and may correspond to selecting or weighting only information necessary to determine whether there is a defect from the sound signal, the driving information, and the cycle information. For example, this may be an step of extracting an input value to be input into the decision neural network B.

A reproduction step T4*b* of reproducing a signal through the extracted value may be performed by the defect diagnoser 342. In the reproduction step T4*b*, a status signal MSE may be reproduced through information extracted from the sound signal and the driving information, and the status signal may be compared with a status signal expected in the normal state at a point in time when a problem has occurred or at the current point in time.

Here, if the status signal MSE exceeds a threshold through comparison with the status signal in the normal state, the defect classification step T5 of classifying the abnormal state as a corresponding defect type by matching the abnormal state with a corresponding defect by comparing the status signal MSE with status signals in the various abnormal states may be performed.

If the status signal MSE does not exceed the threshold through comparison with the status signal in the normal state, the laundry treating apparatus may be determined to be in the normal state, and the diagnosis step T4 may be terminated.

Hereinafter, an embodiment in which the controller detects an abnormal state depending on the type of the abnormal state will be described.

The controller may detect and classify an abnormal state depending on a built-in program, or detect and classify the abnormal state using a matrix network program, such as deep learning.

In the laundry treating apparatus according to the present disclosure, vibration and noise are generated because the drum 4 accommodating laundry in the tub 2 is provided to rotate. When various defects occur in the laundry treating apparatus, vibration and noise are different from those in the normal state. For example, the magnitude of vibration and noise may be larger, the period of vibration and noise may be shortened, or the frequency of vibration and noise may be changed, compared to those in the normal state.

Therethrough, the laundry treating apparatus according to the present disclosure may detect a defective state by analyzing the magnitude, frequency, and period of noise depending on the driving information.

Figure 12:
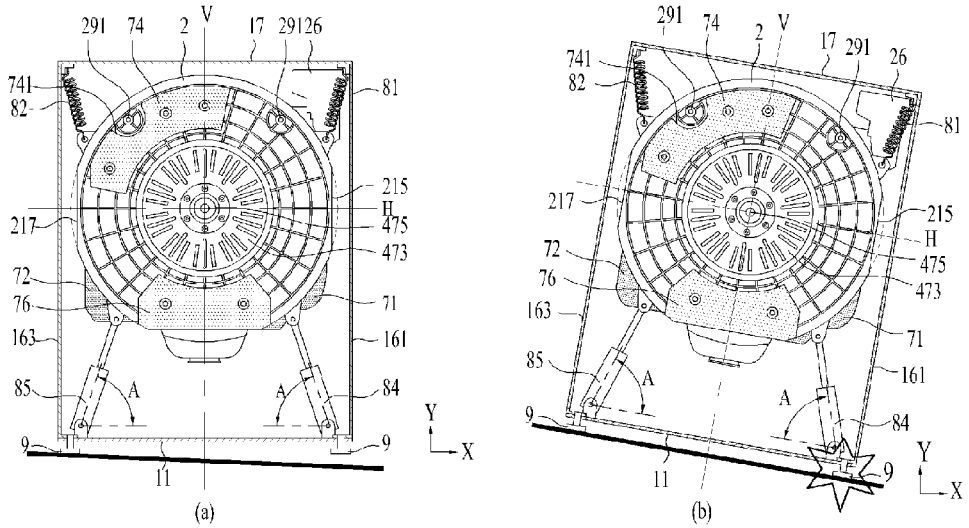
FIG. 12 shows a ground defect of a cabinet.

FIG. 12 shows a ground defect of the cabinet.

The cabinet 1 must be placed parallel to the ground so that the lower surface of the cabinet 1 may be evenly supported on the ground.

The cabinet 1 may be provided with legs 9, which support the cabinet 1, on the lower surface thereof. The legs 9 may be disposed at every corner or vertex of the lower surface of the cabinet 1.

As shown in FIG. 12(*a*), if the cabinet 1 is not placed parallel to the ground and thus a ground defect occurs, at least some of the legs 9 may be spaced apart from the ground.

As shown in FIG. 12(*b*), if strong vibration occurs in the cabinet 1, the leg 9 spaced apart from the ground may repeatedly hit the ground and then be spaced apart from the ground.

Accordingly, impact noise generated when the entirety of the cabinet 1 impacts the ground may be radiated to the outside.

In addition, even though the cabinet 1 is placed parallel to the ground, if at least some of the legs 9 are damaged, a ground defect of the cabinet 1 may occur.

In any case, if a ground defect of the cabinet 1 occurs, a portion of the cabinet 1 may frequently hit the ground. The impact that occurs at this time may not only damage the internal components of the laundry treating apparatus, but also generate uncomfortable noise audible from the outside.

If the ground defect of the cabinet occurs, a portion of the lower part of the cabinet 1 collides with the ground whenever the drum 4 is rotated. Therefore, the magnitude of the noise may be in the area of an abnormal noise that is louder than normal noise.

Further, the number of times the cabinet 1 collides with the ground may be significantly smaller than the rpm of the drum 4.

In addition, since the load of the laundry treating apparatus hits the ground, the frequency of the noise occurring in the event of a ground defect of the cabinet may be lowest in the low-pitched range.

Moreover, the ground defect of the cabinet may occur when the drum 4 is rotated at a designated speed or higher, which causes eccentricity or vibration, and may thus occur in most areas during the course.

Therefore. the laundry treating apparatus according to the present disclosure may recognize the ground defect of the cabinet through detection of the sound signal depending on the driving information. according to characteristics of noise which may occur in the event of the ground defect of the cabinet.

Figure 13:
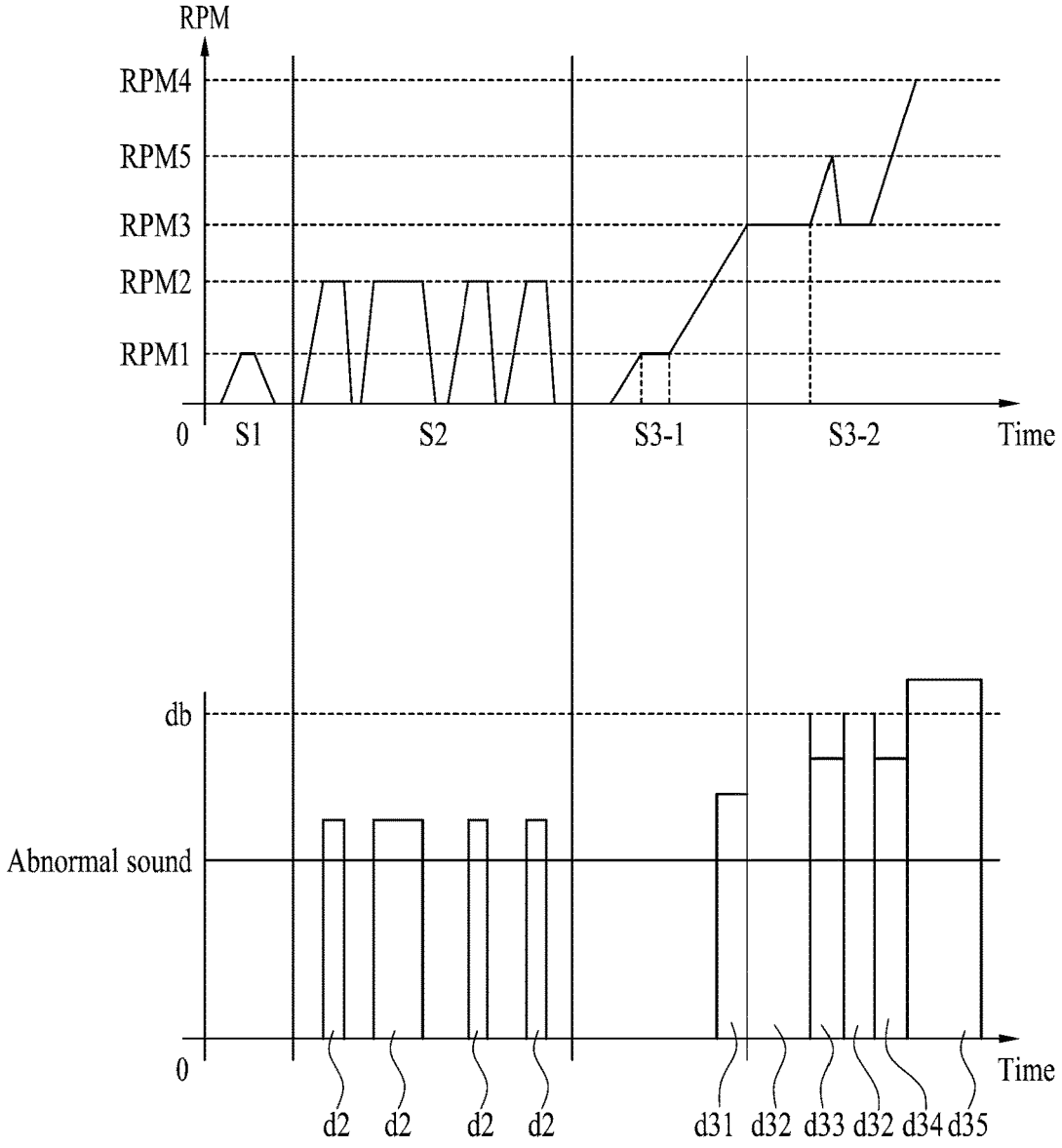
FIG. 13 shows driving information and sound characteristics generated in the event of the ground defect.

FIG. 13 shows driving information and sound characteristics generated in the event of the ground defect.

FIG. 13(*a*) shows driving information when performing a course of the laundry treating apparatus according to the present disclosure.

When the course of the laundry treating apparatus is performed, a laundry weight detection cycle S1 in which the drum or the rotating shaft is rotated at a first speed to detect the weight of laundry through a current value applied or output to the drive part, a washing/rinsing cycle S2 in which the drum or the rotating shaft is rotated at a second speed, which is higher than the first speed, and a spin-drying cycle S3 in which the drum or the rotating shaft is rotated at a third speed, which is higher than the second speed, or higher may be performed.

In the washing/rinsing cycle S2, foreign substances may be removed from the laundry by rotating the drum or the rotating shaft in the clockwise direction or in the counter-clockwise direction while repeating water supply and drainage of the tub 2.

The spin-drying cycle may include a temporary spin-drying cycle S3-1 in which the drum and the rotating shaft are rotated up to the third speed corresponding to the natural frequency of the laundry treating apparatus or lower, and a main spin-drying cycle S3-2 in which the drum and the rotating shaft are rotated up to a fourth speed. which is higher than the third speed, to remove moisture from the laundry through centrifugal force.

The spin-drying cycle may be performed when drainage is completed after the washing/rinsing cycle S2.

The third speed may correspond to a resonance speed that causes a resonance phenomenon in the laundry treating apparatus.

When the laundry treating apparatus according to the present disclosure enters the spin-drying cycle S3, the laundry treating apparatus may increase the rpm of the drum or the rotating shaft 475 to near the third speed and then stand by for a designated time. Thereby, it is possible to detect the degree of excessive vibration or imbalance (eccentricity) while reducing the weight of the laundry by removing moisture from the laundry.

At this time, if the controller 300 determines that there is no problem in further accelerating the drum, the drum or the rotating shaft may be accelerated to the fourth speed to perform the main spin-drying cycle.

The controller 300 may perform a process of raising the RPM of the drum or the rotating shaft to a fifth speed, which is higher than the third speed, and then lowering the RPM of the drum or the rotating shaft again to the third speed, before increasing the RPM of the drum or the rotating shaft to the fourth speed in the main spin-drying cycle S3-2.

The controller 300 may finally detect the weight of the laundry or imbalance through such a process, and may make a final decision on whether to raise the RPM of the drum or the rotating shaft to the fourth speed.

FIG. 13(*b*) shows a sound signal generated in the event of the ground defect.

When the ground defect occurs, abnormal noise may occur whenever the drum 4 is rotated.

The abnormal noise may correspond to noise that is louder (in decibels) than normal noise.

Further, noise generated due to the ground defect may occur in most sections where the drum 4 is rotated.

However, in order for the cabinet 1 to shake due to the ground defect, a physical force greater than a threshold must be generated. Therefore, the force may occur only when the drum 4 or the rotating shaft 475 is rotated at a speed higher than the first speed, or only in the state in which water is accommodated in the tub 2.

In addition, the magnitude of the noise generated due to the ground defect may be increased each time the drum 4 or the rotating shaft 475 is rotated at a higher speed.

For example, if the ground defect occurs, washing abnormal noise d2 may be generated in response to rotation of the drum at the first speed or higher during the washing cycle S2.

In addition, temporary abnormal noise d31 may be generated from when the drum is rotated at the second speed or higher in the temporary spin-drying cycle S3-1 during the spin-drying cycle S3. Since the temporary abnormal noise d31 is generated when the drum 4 or the rotating shaft 475 is rotated at a higher speed, the temporary abnormal noise d31 may have a higher magnitude and a shorter period than the washing abnormal noise d2.

Further, in the main spin-drying cycle S3-2 during the spin-drying cycle S3, resonance abnormal noise d32 may be generated when the drum or the rotating shaft is rotated at the third speed, intermittent abnormal noise d34 may be generated when the drum is rotated at the fifth speed, and the spin-drying abnormal noise d35 may be generated when the drum is rotated at the fourth speed.

Although the resonance abnormal noise d32 has a lower rpm of the rotating shaft than the intermittent abnormal noise d34 or the spin-drying abnormal noise d35, the resonance abnormal noise d32 may be the loudest due to the resonance shape thereof.

However, the resonance abnormal noise d32 has the lower rpm of the rotating shaft than the intermittent abnormal noise d34 and the spin-drying abnormal noise d35. and may thus have a short noise generation period.

The spin-drying abnormal noise d35 may have a greater magnitude and a shorter period than the intermittent abnormal noise d34.

Meanwhile, the ground defect causes noise when the entirety of the laundry treating apparatus collides with the ground or changes position, the magnitude of the noise from the ground defect may be the greatest among noises from all defects.

Further, since the entirety of the laundry treating apparatus is more difficult to move than components in the laundry treating apparatus, the period of the abnormal noise from the ground defect may be the longest among abnormal noises from other defects.

In addition, since the noise caused by collision of the cabinet 1 or the leg 9 with the ground is relatively dull, the abnormal noise from the ground defect may have the lowest frequency in the low-pitched range among the abnormal noises from other defects.

In this way, the controller 300 may recognize and classify the ground defect depending on the characteristics of driving information and the sound signal.

Of course, the laundry treating apparatus according to the present disclosure may further include an acceleration sensor, such as a gyro sensor that may detect a change in position or movement of the cabinet 1. The acceleration sensor may be fixed to the cabinet 1 or the display panel d.

The controller 300 may recognize that a ground defect has occurred when an acceleration detected by the acceleration sensor exceeds a threshold.

Figure 14:
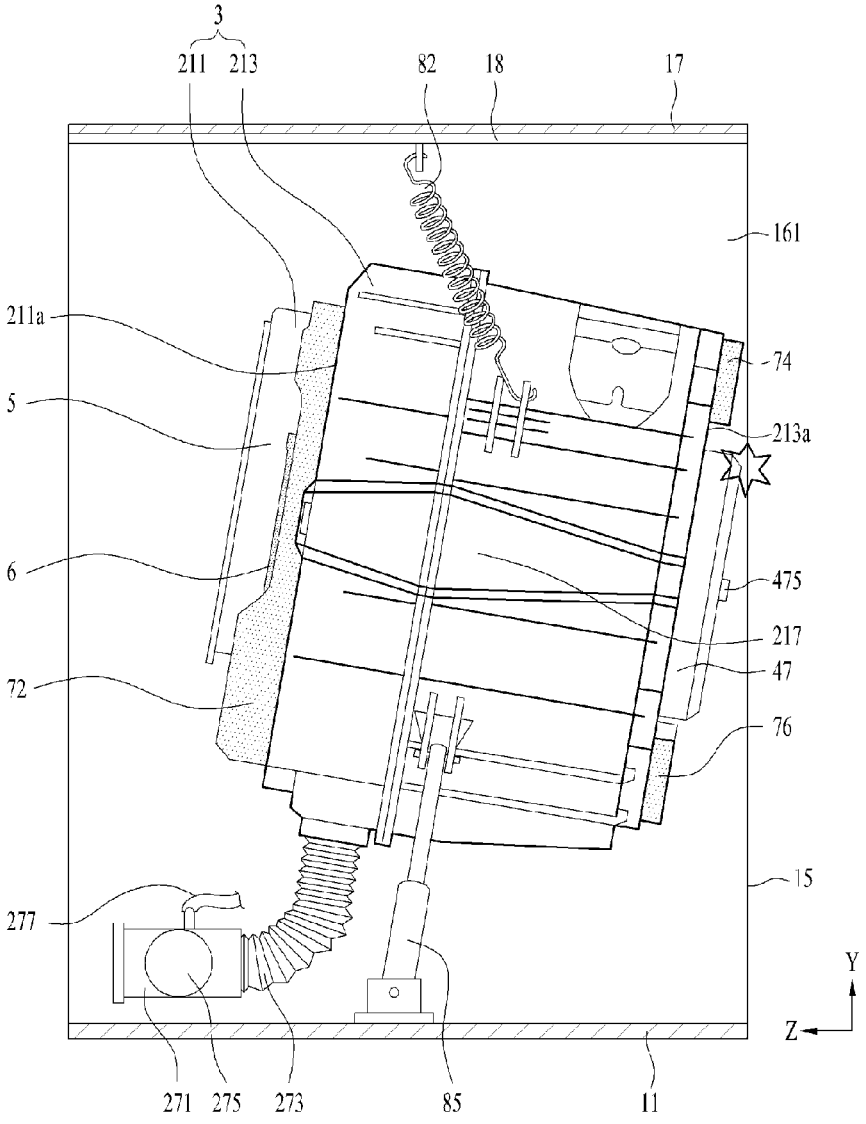
FIG. 14 shows a vibration defect of the cabinet.

FIG. 14 shows a vibration defect of the cabinet.

On the grounds that the tub 2 vibrates excessively. the tub supports 80 are damaged or deformed, or the drum 4 generates a resonance phenomenon in the state in which the tub 2 is very heavy, etc., the tub 2 may collide with the cabinet 1. Accordingly, the tub 2 may collide with the rear panel 15, or the tub 2 may collide with the side panel 16.

In addition, the rear panel 15 may be vulnerable to vibration because the water supply valve or the drain pipe is coupled to the rear panel 15 and the rear panel 15 has a relatively small thickness. Accordingly, noise may be generated due to independent vibration of the rear panel 15 caused by poor coupling or support thereof.

As a result, the cabinet may collide with the tub 2 or vibrate excessively on its own, thereby generating a vibration defect.

Such a vibration defect may weaken durability of the laundry treating apparatus itself and, in severe cases, may cause a safety incident, and thus needs to be checked immediately.

Unlike the ground defect, the vibration defect causes noise from the relatively light tub and cabinet themselves.

As a result, the magnitude of abnormal noise generated in the event of the vibration defect may be smaller than the magnitude of abnormal noise generated in the event of the ground defect.

Further, the cabinet 1 and the tub 2 may be lighter and easier to move than the entirety of the laundry treating apparatus.

As a result, the period of the abnormal noise generated in the event of the vibration defect may be longer than a period corresponding to the rpm of the drum, but may be shorter than the period of the abnormal noise generated in the event of the ground defect.

Further, the collision noise between the cabinet 1 and the tub 2 may be higher-pitched than the noise generated due to collision of the cabinet 1 or the leg 9 with the ground.

As a result, the frequency of the abnormal noise generated in the event of the vibration defect may be higher than the frequency of the abnormal noise generated in the event of the ground defect.

In addition, since the vibration defect occurs only when strong vibration occurs in the cabinet 1 or the tub 2, the duration or noise generation section of the abnormal noise generated in the event of the vibration defect may be smaller than the duration or noise generation section of the abnormal noise generated in the event of the ground defect.

Accordingly, the controller 300 of the laundry treating apparatus according to the present disclosure may detect an abnormal state of the laundry treating apparatus by analyzing a sound signal depending on driving information, and may classify the abnormal state as a vibration defect.

Figure 15:
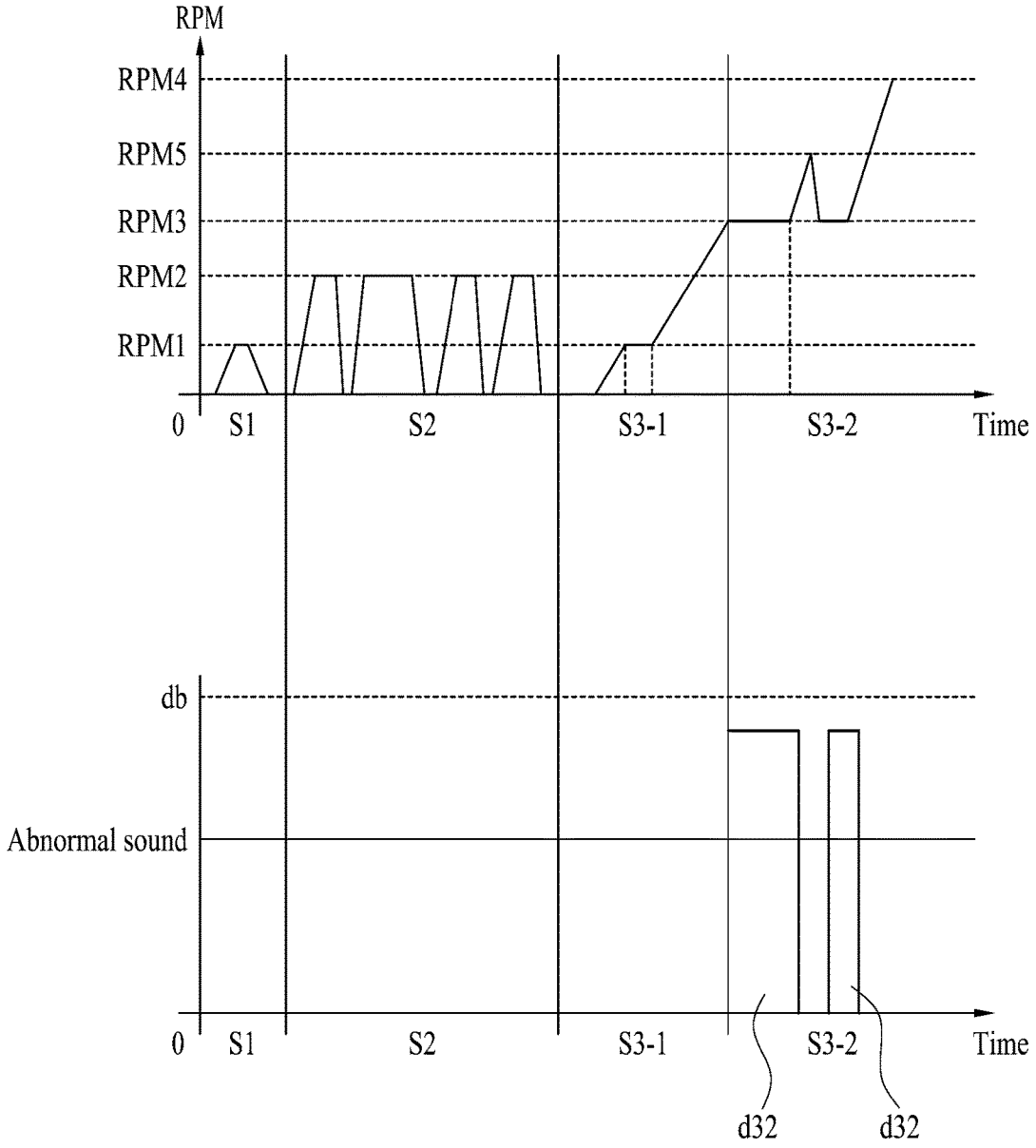
FIG. 15 shows an example of a sound signal and driving information in the event of the vibration defect of the cabinet.

FIG. 15 shows an example of a sound signal and driving information in the event of the vibration defect of the cabinet.

FIG. 15(*a*) shows driving information when performing the course of the laundry treating apparatus according to the present disclosure.

FIG. 15(*b*) shows a sound signal generated in the event of the vibration defect.

As described above. the vibration defect of the cabinet occurs when the tub 2 vibrates excessively and collides with the cabinet 1. or when the panels including the rear panel 15 of the cabinet 1 vibrate excessively.

Accordingly, the vibration defect of the cabinet may occur intensively in the spin-drying cycle S3 in which the drum 4 or the rotating shaft 145 is rotated at a high speed.

Further, the vibration defect may occur intensively in a section where vibration is particularly severe during the spin-drying cycle S3. For example, the vibration defect of the cabinet may occur when a resonance phenomenon occurs in the laundry treating apparatus when the drum or the rotating shaft 145 is rotated at the third speed, or when the drum is rotated at the third speed or higher in the state in which eccentricity inside the drum 4 is severe.

For example, in the case of the vibration defect, when the drum 4 is rotated at the third speed and the resonance phenomenon occurs, resonance abnormal noise d32 may be generated. However, when the drum 4 is rotated at a speed higher the third speed. the vibration amplitude of the tub 2 or the cabinet 1 becomes small, and thus, the abnormal noise may not be generated.

As such, the controller may recognize and classify the vibration defect depending on the characteristics of the driving information and the sound signal.

Figure 16:
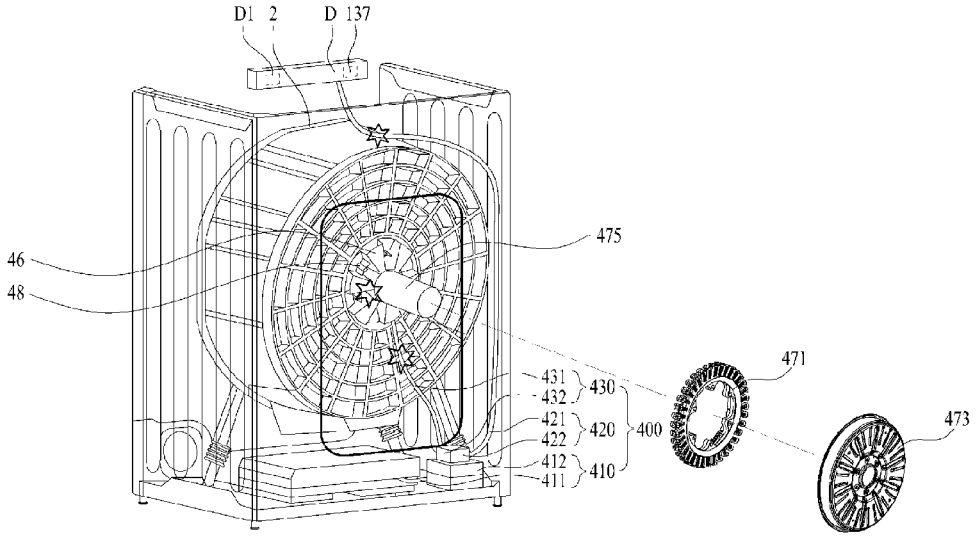
FIG. 16 shows a fastening defect of the harness and a driving defect of the drive part.

FIG. 16 shows a fastening defect of the harness and a driving defect of the drive part.

The fastening defect of the harness may be a state in which the wires 411, 421, and 431 provided in the harness 400 are separated from the inner wall of the cabinet 1 or the outer wall of the tub 2, or the coupling parts 412, 422, and 432 of the harness 400 are separated from each other.

At this time, when the drive part 47 is driven. the wires 411, 421, and 431 may frequently collide with the cabinet 1 or the tub 2, and may thus generate abnormal noise.

In addition, when the drive part 47 is driven. the separated coupling parts 412, 422, and 432 may collide with the cabinet 1 or the tub 2, and may thus generate abnormal noise.

However, the fastening defect causes noise generated by collision of the very light wires 411, 421, and 431 or the coupling parts 412, 422, and 432 formed of plastic with the tub 2 or the cabinet 1, unlike the vibration defect or the ground defect.

Therefore, the magnitude of abnormal noise generated in the event of the fastening defect may be smaller than the magnitude of abnormal noise generated in the event of the ground defect or the vibration defect.

Further, since the harness 40 is light in weight, it may more easily and frequently collide with the cabinet 1 or the tub 2. Accordingly, the period of the abnormal noise generated in the event of the fastening defect may be longer than the period corresponding to the rpm of the drum, but may be shorter than the period of the abnormal noise generated in the event of the vibration defect of the ground defect.

In addition, the noise generated due to collision of the light harness 400 with the cabinet 1 and the tub 2 may be relatively light or close to a high-pitched sound. Therefore, the frequency of the abnormal noise generated in the event of the fastening defect may be higher than the frequency of the abnormal noise generated in the event of the vibration defect or the ground defect.

In the meantime, since the harness 400 moves easily even when a small amount of energy is transmitted thereto, the fastening defect may occur continuously in a wide section where the drive part 47 is driven. Therefore, the generation section of the abnormal noise generated in the event of the fastening defect may be longer than the generation section of the abnormal noise generated in the event of the vibration defect or the ground defect.

Therefore, the controller 300 of the laundry treating apparatus according to the present disclosure may detect an abnormal state of the laundry treating apparatus by analyzing a sound signal depending on driving information, and may classify the abnormal state as a vibration defect.

Meanwhile, if the drive part 47 is poorly coupled to the tub 2, a driving defect may occur.

For example, the driving defect may include poor coupling between the bearing housing 46 and the rotating shaft 475.

For example, the bearing housing 46 may be misaligned with the rotating shaft 475, or the lubricating force in the bearing housing 46 may be reduced, thereby generating strong frictional force between the rotating shaft 475 and the bearing housing 46.

Further, the driving defect may include a problem occurring in coupling of the stator 471 with the bearing housing 46, a problem occurring in coupling of a coupling member 48 coupled to the stator 471, or contact of the rotor 473 with the bearing housing 46 or the tub 2.

Therefore, the driving defect may generate abnormal noise in the entire section when the rotating shaft 475 is rotated.

For example, if the bearing housing 46 has a support defect with the rotating shaft 475, friction noise between the rotating shaft 475 and the bearing housing 46 may be generated whenever the rotating shaft 475 is rotated.

Further, when the rotating shaft 475 is rotated in the state in which coupling between the bearing housing 46 and the stator 471 is poor, friction noise may be generated between the stator 471 and the bearing housing 46 due to vibration, or friction noise may be generated between the coupling member 47 and the stator 471.

In addition, when the rotating shaft 475 is rotated in the state in which the rotor 473 is capable of partially contacting the tub 2, the rotor 473 and the tub 2 may collide with each other.

As a result, the abnormal noise generated in the event of the driving defect may directly correspond to rotation of the rotating shaft 475.

Therefore, the period of the abnormal noise generated in the event of the driving defect may directly correspond to the rpm of the rotating shaft 475. That is, the period of the abnormal noise generated in the event of the driving defect may be shorter than the periods of the abnormal noises generated in the event of all other defects.

Further, since most portions of the drive part 47 are formed of metal, the abnormal noise generated in the event of the driving defect may be in a high-pitched range. Therefore, the frequency of the abnormal noise generated in the event of the driving defect may be higher than the frequencies of the abnormal noises generated in the event of all other defects.

As a result, the controller 300 may recognize and classify one or more of the fastening defect and the driving defect by analyzing the characteristics of the driving information and the sound signal.

Figure 17:
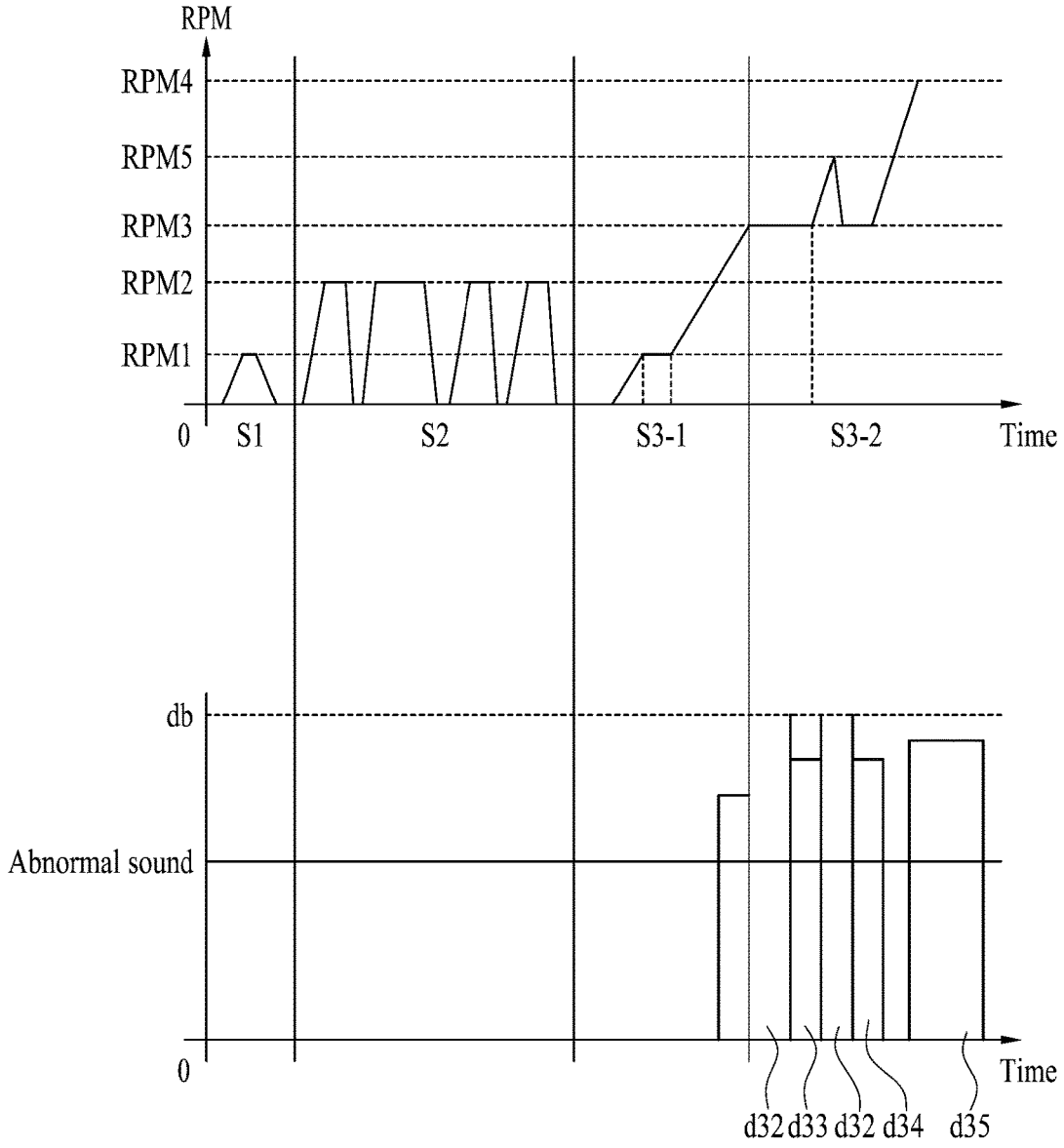
FIG. 17 shows an example of a sound signal and driving information in the event of the fastening defect of the harness.

FIG. 17 shows an example of a sound signal and driving information in the event of the fastening defect of the harness.

FIG. 17(*a*) shows driving information when performing the course of the laundry treating apparatus according to the present disclosure.

FIG. 17(*b*) shows a sound signal generated in the event of the fastening defect of the harness.

When the fastening defect of the harness occurs, the wires and the coupling parts of the harness collide with the cabinet or the tub. However, when the rotation speed of the drum 4 is low, the collision noise is small and may not reach an area corresponding to abnormal noise.

For example, even if noise is generated due to the fastening defect in the laundry weight detection cycle S1 or the washing/rinsing cycle S2, the magnitude of the noise may be smaller than that of the abnormal noise (dB).

However, in the spin-drying cycle S3, the rotation speed of the drum 4 is high, the vibration amplitude and vibration period of the harness 400 increase, and thus, abnormal noise may be generated when the harness 40 collides with the cabinet 1 and the tub 2.

For example, if the fastening defect of the harness 400 occurs, abnormal noise may be generated in the entire section where the rotation speed of the drum 4 is higher than the second speed in the spin-drying cycle S3.

The abnormal noise generated in the event of the fastening defect of the harness 400 may increase in proportion to the rotation speed of the drum 4.

The abnormal noise generated in the event of the fastening defect of the harness 400 may include temporary abnormal noise d31 generated in an area in which the drum 4 is rotated at a speed higher than the second speed in the temporary spin-drying cycle S3-1.

Further, the abnormal noise generated in the event of the fastening defect of the harness 400 may include resonance abnormal noise d32 generated in a resonance section in which the drum 4 is rotated at the third speed in the main spin-drying cycle s3, and the resonance abnormal noise d32 may be louder than the temporary abnormal noise d31.

Further. the abnormal noise generated in the event of the fastening defect of the harness 400 may include spin-drying abnormal noise d35 generated when the drum 4 is rotated at the fourth speed, and the spin-drying abnormal noise d35 may be quieter than the resonance abnormal noise d32.

Further. the abnormal noise generated in the event of the fastening defect of the harness 400 may include intermittent abnormal noise d34 generated when the drum 4 is rotated at the fifth speed, and the intermittent abnormal noise s34 may be quieter than the spin-drying abnormal noise d35.

Figure 18:
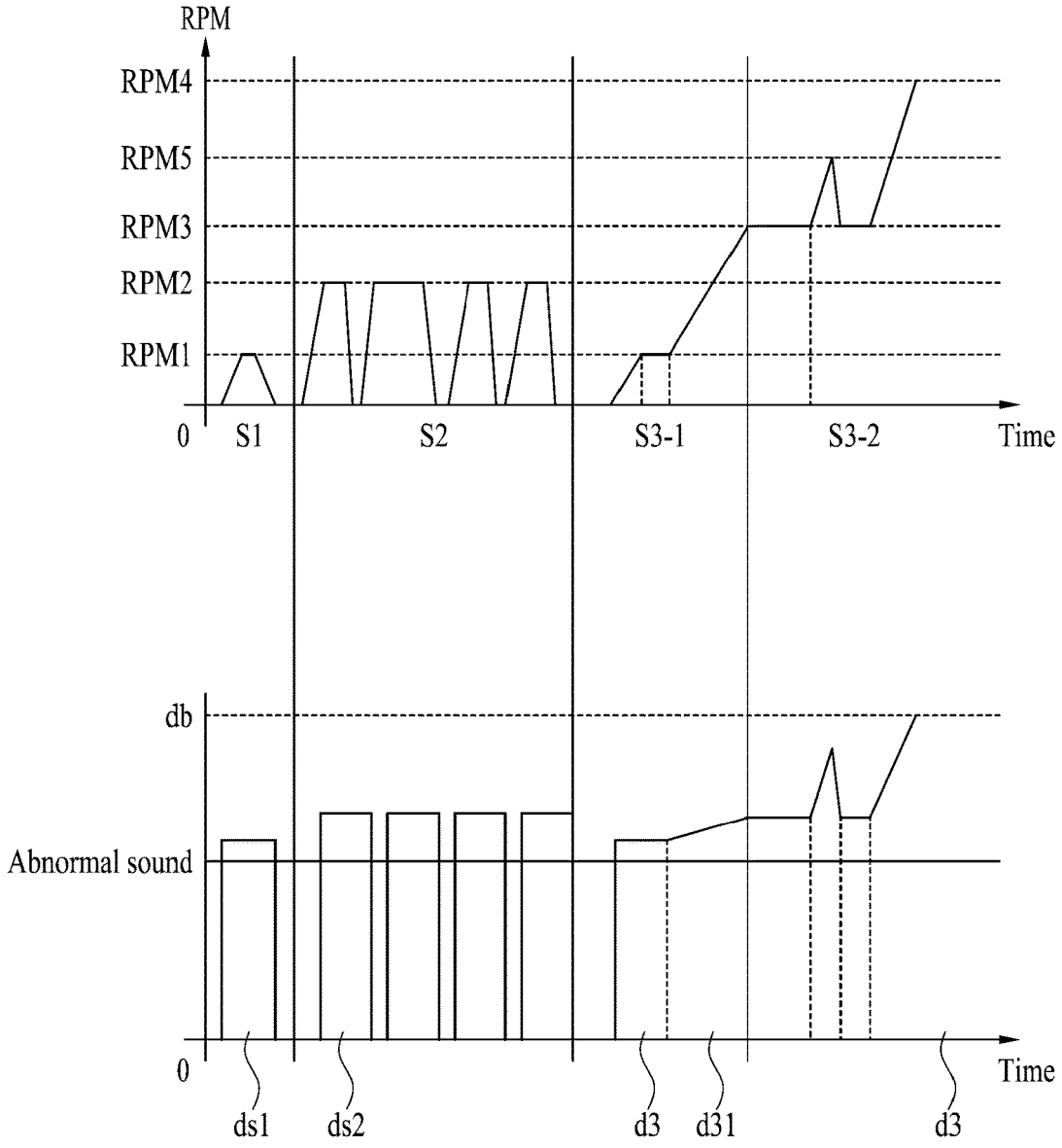
FIG. 18 shows an example of a sound signal and driving information in the event of the fastening defect of the harness.

FIG. 18 shows another example of a sound signal and driving information in the event of the fastening defect of the harness.

FIG. 18(*a*) shows driving information when performing the course of the laundry treating apparatus according to the present disclosure.

FIG. 18(*b*) shows a sound signal generated in the event of the driving defect of the drive part.

If the driving defect occurs. abnormal noise (dB) may be generated in all sections where the drum 4 is rotated.

For example, the abnormal noise generated in the event of the driving defect may include laundry weight abnormal noise ds1 generated when the drum is rotated at the first speed in the laundry weight detection cycle s1.

Further, the abnormal noise generated in the event of the driving defect may include washing abnormal noise ds2 generated when the drum is rotated at the second speed in the washing/rinsing cycle s2.

Further, the abnormal noise generated in the event of the driving defect may include temporary abnormal noise d31 generated when the drum 4 is rotated at the third speed or lower in the temporary spin-drying cycle S3-1.

Further, the abnormal noise generated in the event of the driving defect may include spin-drying abnormal noise d35 generated when the drum 4 is rotated at the fourth speed. and intermittent abnormal noise d34 generated when the drum 4 is rotated at the fifth speed, in the main spin-drying cycle s3-2.

The abnormal noise generated in the event of the driving defect may be continuously generated when the rotating shaft 475 is rotated, and may increase or decrease in proportion to rotation of the rotating shaft 475.

Figure 19:
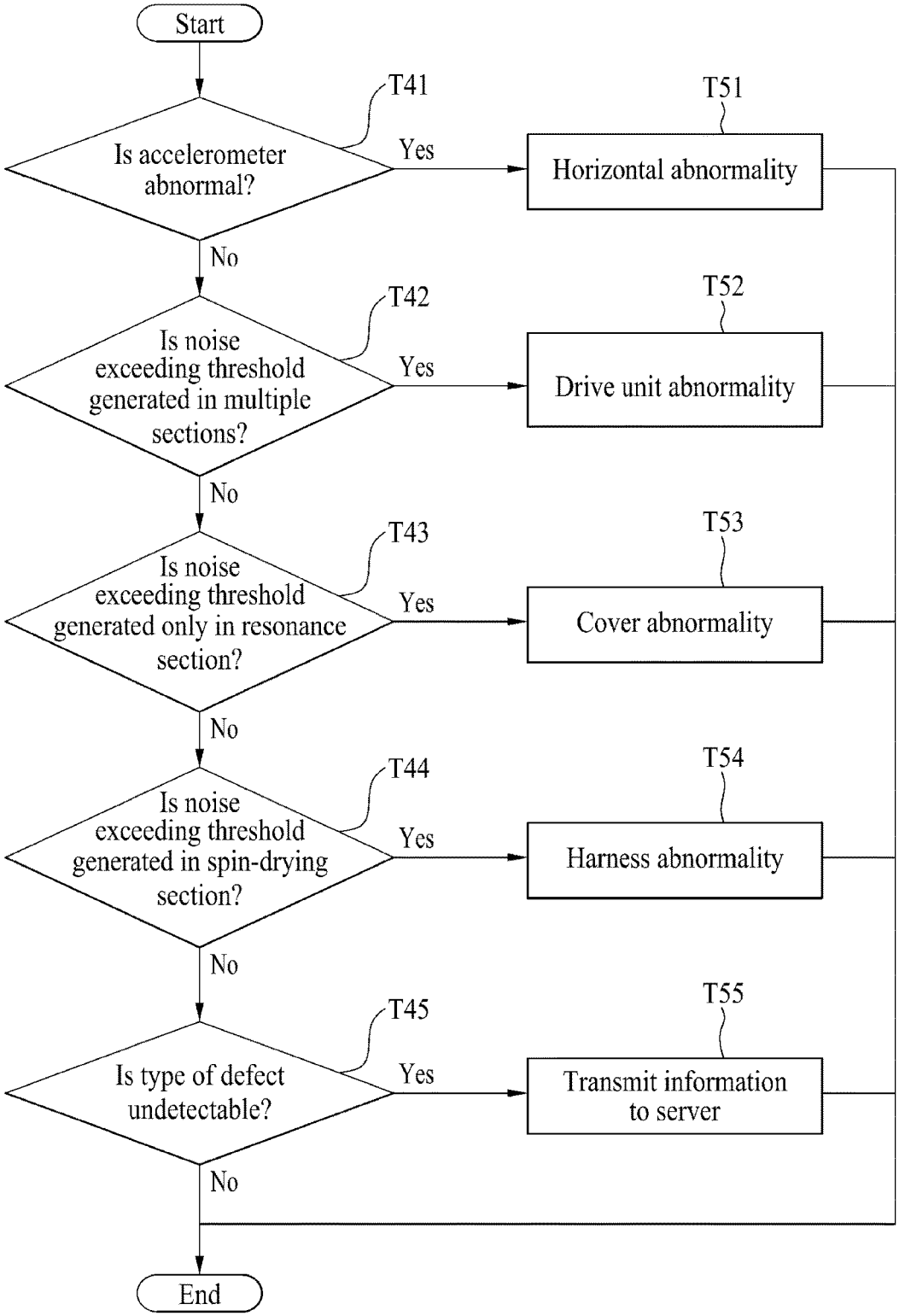
FIG. 19 shows one embodiment of a control method of diagnosing a defect by a defect diagnoser and classifying the defect by a defect classifier.

FIG. 19 shows one embodiment of a control method of diagnosing a defect by the defect diagnoser and classifying the defect by the defect classifier.

The laundry treating apparatus according to the present disclosure detects an abnormal state in the abnormality diagnosis step T3, an acceleration abnormality step T41 of detecting whether the acceleration detected by the acceleration sensor exceeds the threshold may be performed in the defect diagnosis step T4.

At this time, if the acceleration exceeds the threshold, a ground defect step T51 of determining that the abnormal state is a horizontal abnormality or a ground defect may be performed.

However, if the detected acceleration does not exceed the threshold, a section detection step T42 of detecting whether or not abnormal noise exceeding the threshold is generated in other sections including the spin-drying cycle in the defect diagnosis step T4.

If the abnormal noise is generated in sections other than the spin-drying cycle, a driving defect step T52 of determining that the abnormal noise is generated due to a driving defect may be performed in the defect diagnosis step T5.

However, if the abnormal noise is generated only in the spin-drying cycle, a specific detection step T43 of detecting whether the abnormal noise is generated only in a section where the overall vibration of the laundry treating apparatus is strong, such as the resonance section, may be performed in the defect diagnosis step T4.

If the abnormal noise is generated only in some sections or the resonance section during the spin-drying cycle, a vibration defect step T53 of determining that the abnormal noise is generated due to a vibration defect may be performed in the defect diagnosis step T5.

Further, in the defect diagnosis step 4, a section detection step T44 of detecting whether the abnormal noise is generated in the entire section of the spin-drying cycle or the entire section of the main spin-drying cycle may be performed.

If the abnormal noise exceeding the threshold is generated in the entire section of the main spin-drying cycle, the defect diagnosis step T5 may include a harness defect step T54 of determining that the abnormal noise is generated due to a fastening defect of the harness.

In addition, a detectability determination step T45 of determining whether the defect classifier 343 is not able to detect what type of defect the abnormal state is although the defect diagnoser 342 has detected the abnormal state deviating from the normal state may be performed.

If the defect classifier 343 is not able to detect what type of defect the abnormal state is, a server transmission step T55 of allowing the controller 300 to provide all information regarding the abnormal state, such as driving information, a sound signal, and cycle information, to the server 300 may be performed.

The present disclosure may be modified and implemented in various forms, and the scope of the disclosure is not limited by the above-described embodiments. Therefore, if a modified embodiment includes elements of the claims of the present disclosure, it should be considered to fall within the scope of the present disclosure.

What is claimed is:

1. A laundry treating apparatus comprising:

a cabinet;

a tub provided in the cabinet to store water;

a drum rotatably provided in the tub to accommodate laundry;

a drive part coupled to the tub to rotate the drum;

a microphone configured to detect noise generated in the cabinet or transmitted therefrom;

a controller configured to control at least one of the drive part or the microphone and perform an arbitrary course to wash or dry the laundry;

a display part configured to display a state of the controller outside; and a harness configured to connect at least one of the drive part, the microphone, or the display to the controller, wherein the controller is provided to receive:

(i) a sound signal comprising at least one of a magnitude of the noise detected by the microphone, a frequency of the noise, or a period of the noise; and (ii) driving information comprising a current value, rpm, a laundry weight, and eccentricity output from the drive part; and wherein the controller is provided to detect an abnormal state comprising at least one of a ground defect of the cabinet, a vibration defect of the cabinet, a driving defect of the drive part, or a fastening defect of the harness.

2. The laundry treating apparatus according to claim 1, wherein the controller is provided to detect the abnormal state by receiving at least one of the magnitude, period, or frequency of the noise depending on a change in the rpm of the drive part.

3. The laundry treating apparatus according to claim 1, wherein the controller is provided to classify the ground defect, the vibration defect, the fastening defect, and the driving defect in order of the period of the noise from longest to shortest, in case that the magnitude of the noise is greater than a reference value.

4. The laundry treating apparatus according to claim 1, wherein the controller is provided to classify the ground defect, the vibration defect, the fastening defect, and driving defect in order of the frequency of the noise from lowest to highest, in case that the magnitude of the noise is greater than a reference value.

5. The laundry treating apparatus according to claim 1, wherein the controller is provided to determine that the driving defect has occurred in case that the magnitude of the noise is greater than or equal to a reference value.

6. The laundry treating apparatus according to claim 1, wherein the controller is provided to determine that the driving defect has occurred in case that the period of the noise corresponds to the rpm of the drive part.

7. The laundry treating apparatus according to claim 1, wherein the course comprises:

a laundry weight detection step configured such that the drive part rotates at a first rpm;

a washing/rinsing step configured such that the drive part rotates at a second rpm higher than the first rpm; and a spin-drying step configured such that the drive part rotates at a third rpm higher than the second rpm, or higher, wherein the controller is provided to exclude the driving defect from the abnormal state in case that the magnitude of the noise is greater than a reference value only in one of the laundry weight detection step, the washing/rinsing step, and the spin-drying step.

8. The laundry treating apparatus according to claim 1, wherein the course comprises:

a laundry weight detection step configured such that the drive part rotates at a first rpm;

a washing/rinsing step configured such that the drive part rotates at a second rpm higher than the first rpm; and a spin-drying step configured such that the drive part rotates at a third rpm higher than the second rpm, or higher, wherein the controller is provided to determine that the ground defect of the cabinet has occurred in case that the magnitude of the noise is greater than a reference value in the washing/rinsing step and the spin-drying step.

9. The laundry treating apparatus according to claim 1, wherein the course comprises:

a laundry weight detection step configured such that the drive part rotates at a first rpm;

a washing/rinsing step configured such that the drive part rotates at a second rpm higher than the first rpm; and a spin-drying step configured such that the drive part rotates at a third rpm higher than the second rpm, or higher, wherein the controller is provided to exclude the ground defect of the cabinet or the driving defect from the abnormal state in case that the magnitude of the noise is greater than a reference value in the spin-drying step.

10. The laundry treating apparatus according to claim 9, wherein the spin-drying step comprises:

a temporary spin-drying step configured such that the drive part rotates at the third rpm or lower to generate strong vibration; and a main spin-drying step configured such that the drive part rotates at the third rpm or higher, wherein the controller determines that the vibration defect has occurred if the noise having the magnitude greater than the reference value is generated in the temporary spin-drying step or when the drive part rotates at the third rpm, and is not generated in the main spin-drying step.

11. The laundry treating apparatus according to claim 10, wherein the vibration defect occurs due to collision between the cabinet and the tub.

12. The laundry treating apparatus according to claim 10, wherein the cabinet comprises:

a front panel having an opening configured such that the laundry is put into the tub therethrough; and a rear panel provided to face the front panel, wherein the vibration defect occurs due to collision of the rear panel with the tub or the drive part.

13. The laundry treating apparatus according to claim 10, wherein the cabinet comprises:

a front panel having an opening configured such that the laundry is put into the tub therethrough; and a rear panel provided to face the front panel, wherein the vibration defect occurs due to bending or vibration of the rear panel.

14. The laundry treating apparatus according to claim 9, wherein the spin-drying step comprises:

a temporary spin-drying step configured such that the drive part rotates at the third rpm or lower to generate strong vibration; and a main spin-drying step configured such that the drive part rotates at the third rpm or higher, wherein the controller determines that the fastening defect has occurred if the noise having the magnitude greater than the reference value is generated in the temporary spin-drying step and the main spin-drying step.

15. The laundry treating apparatus according to claim 1, further comprising a communication module provided to transmit the abnormal state detected by the controller to an external terminal or a server, wherein the controller is provided to transmit the sound signal and the driving information to the server or the external terminal when the controller detects an abnormal state other than the ground defect of the cabinet, the vibration defect of the cabinet, the driving defect of the drive part, and the fastening defect of the harness.

16. The laundry treating apparatus according to claim 1, wherein the controller, upon receiving the sound signal and the driving information, is provided to reproduce sound signal and driving information of the abnormal state so as to determine whether there is an abnormality.

* * * * *